US012709860B2

(12) United States Patent
Jaycox et al.

(10) Patent No.: US 12,709,860 B2
(45) Date of Patent: Aug. 18, 2026

(54) INTEGRATED FOUNDATION LEVELING SYSTEM

(71) Applicant: Situ-Places, Inc., Santa Cruz, CA (US)

(72) Inventors: Stephen W Jaycox, Natick, MA (US); Quentin Topping, Santa Cruz, CA (US); Michael Goldin, Novato, CA (US)

(73) Assignee: Situ-Places, Inc., Santa Cruz, CA (US)

( * ) Notice: Subject to any disclaimer, the term of this patent is extended or adjusted under 35 U.S.C. 154(b) by 59 days.

(21) Appl. No.: 18/646,615

(22) Filed: Apr. 25, 2024

(65) Prior Publication Data

US 2024/0360643 A1 Oct. 31, 2024

Related U.S. Application Data

(60) Provisional application No. 63/498,244, filed on Apr. 25, 2023.

(51) Int. Cl.
*E02D 35/00* (2006.01)

(52) U.S. Cl.
CPC ..... *E02D 35/005* (2013.01); *E02D 2600/10* (2013.01)

(58) Field of Classification Search
CPC ..... E02D 35/00; E02D 35/005
See application file for complete search history.

(56) References Cited

U.S. PATENT DOCUMENTS

| | | | |
|---|---|---|---|
| 3,468,094 | A | 9/1969 | Campbell |
| 3,514,910 | A | 6/1970 | Comm |
| 3,634,985 | A | 1/1972 | Tipton |
| 3,716,954 | A | 2/1973 | Kelbish |
| 3,721,056 | A | 3/1973 | Toan et al. |
| 4,793,110 | A | 12/1988 | Tucker |
| 5,239,798 | A | 8/1993 | Saito |
| 5,722,798 | A | 3/1998 | Gregory |
| 5,797,227 | A | 8/1998 | Garza-Tamez |
| 6,550,199 | B2 | 4/2003 | Phillips |
| 7,785,039 | B1 | 8/2010 | McCown, Sr. |
| 8,621,818 | B1 | 1/2014 | Glenn et al. |
| 8,943,759 | B2 | 2/2015 | Warner et al. |
| 9,085,901 | B2 | 7/2015 | Mueller |
| 9,121,168 | B2 | 9/2015 | Levy et al. |
| 9,441,359 | B1 | 9/2016 | Hsieh |

(Continued)

FOREIGN PATENT DOCUMENTS

| | | | | |
|---|---|---|---|---|
| CN | 108343102 B | * | 2/2024 | ..... E02D 35/005 |
| EP | 0457973 A | | 11/1991 | |

(Continued)

OTHER PUBLICATIONS

International Search Report and Written Opinion from corresponding International Patent Application No. PCT/US24/26350, dated Aug. 14, 2024.

(Continued)

*Primary Examiner* — Frederick L Lagman

(74) *Attorney, Agent, or Firm* — Dergosits & Noah LLP

(57) ABSTRACT

Apparatuses, systems, and methods detect and alert to the settlement of building foundations due to, e.g., permafrost, soil or sand subsidence, and provide an actuator-based solution to re-set structures above such foundations in need of correction and/or re-leveling.

16 Claims, 26 Drawing Sheets

(56) References Cited

U.S. PATENT DOCUMENTS

| | | | | |
|---|---|---|---|---|
| 10,837,168 | B2 | 11/2020 | Rittmanic | |
| 11,619,556 | B1 | 4/2023 | Chen et al. | |
| 11,859,363 | B2 * | 1/2024 | Jaycox | E02D 35/00 |
| 11,871,311 | B2 * | 1/2024 | Hill | H04W 4/33 |
| 12,352,061 | B2 | 7/2025 | Jaycox et al. | |
| 2002/0076281 | A1 | 6/2002 | Gregory et al. | |
| 2004/0081518 | A1 | 4/2004 | Stankus et al. | |
| 2005/0117976 | A1 | 6/2005 | Jones | |
| 2011/0214361 | A1 | 9/2011 | Ingjaldsdottir et al. | |
| 2012/0207550 | A1 | 8/2012 | Aksel et al. | |
| 2013/0239487 | A1 | 9/2013 | Ingjaldsdottir et al. | |
| 2014/0059947 | A1 | 3/2014 | Rothwell et al. | |
| 2014/0115976 | A1 | 5/2014 | Lippert | |
| 2014/0123572 | A1 | 5/2014 | Segall | |
| 2014/0154015 | A1 | 6/2014 | Jung et al. | |
| 2015/0247316 | A1 | 9/2015 | Coupe | |
| 2017/0067220 | A1 | 3/2017 | Grover | |
| 2018/0230707 | A1 | 8/2018 | Parker | |
| 2018/0355600 | A1 | 12/2018 | Yang | |
| 2020/0087882 | A1 * | 3/2020 | Boucher | E04G 23/065 |
| 2020/0131761 | A1 | 4/2020 | Markman et al. | |
| 2020/0149266 | A1 | 5/2020 | Griechen et al. | |
| 2021/0372074 | A1 | 12/2021 | Hodge | |
| 2021/0395042 | A1 | 12/2021 | Collins et al. | |
| 2022/0381050 | A1 | 12/2022 | Jaycox et al. | |
| 2023/0125602 | A1 * | 4/2023 | Jaycox | E02D 35/00 405/232 |
| 2023/0145279 | A1 | 5/2023 | Snorrason | |

FOREIGN PATENT DOCUMENTS

| | | | |
|---|---|---|---|
| JP | 05025826 | A | 2/1993 |
| JP | 10-30230 | A | 2/1998 |
| JP | 2011-202450 | A | 10/2011 |
| KR | 10-2013-0047235 | A | 5/2013 |
| KR | 10-2039443 | B1 | 11/2019 |
| WO | 19990028572 | | 6/1999 |

OTHER PUBLICATIONS

Ellis Manufacturing Company Inc., "Screw Jacks / Jack Posts / Lally Columns," https://ellismanufacturing.com/collections/screw-jacks, downloaded Jul. 1, 2024.

Zimm USA Inc., "Replacing Hydraulic Lifting Systems with Electro-Mechanical Screw Jacks," https://en-us.zimm.com/replacing-hydraulic-lifting-systems-with-electro-mechanical-screw-jacks/, Jun. 25, 2020.

Zimm USA Inc., "Areas of use and applications," https://en-us.zimm.com/products/areas-of-use-and-applications/, downloaded Jul. 1, 2024.

Extended European Search Report from related European Patent Application No. 22888475.5 dated Jan. 20, 2026.

Surveying solutions, Leica Geosystems, retrieved Feb. 22, 2023 from https://leica-geosystems.com/en-us/industries/pure-surveying/surveying-solutions.

"Stewart Platform" entry from Wikipedia, retrieved Feb. 22, 2022 from https://en.wikipedia.org/Stewart_platform.

Spectra-Precision Focus35 Series Robotic Packages retrieved Feb. 22, 2023 from https://www.allenprecision.com/focus35-series-robotic-packages.

CON-iCB70 Manual Total Station, Leica Geosystems, retrieved Feb. 22, 2023 from https://leica-geosystems.com/en-us/products/construction-tps-and-gnss/manual-total-stations/leica-icon-icb70.

International Search Report and Written Opinion from corresponding International Patent Application No. PCT/US22/78736 dated Mar. 7, 2023.

International Search Report and Written Opinion from related International Patent Application No. PCT/US22/31831 dated Sep. 15, 2022.

Connect Home Series Brochure—downloaded Aug. 9, 2022—publication date unknown.

Screen capture from http://blueskybuildingsystems.com/offerings, created by others, as retrieved May 29, 2021.

* cited by examiner

CORRECTION PROCESS W/ REMOVABLE ACTUATORS

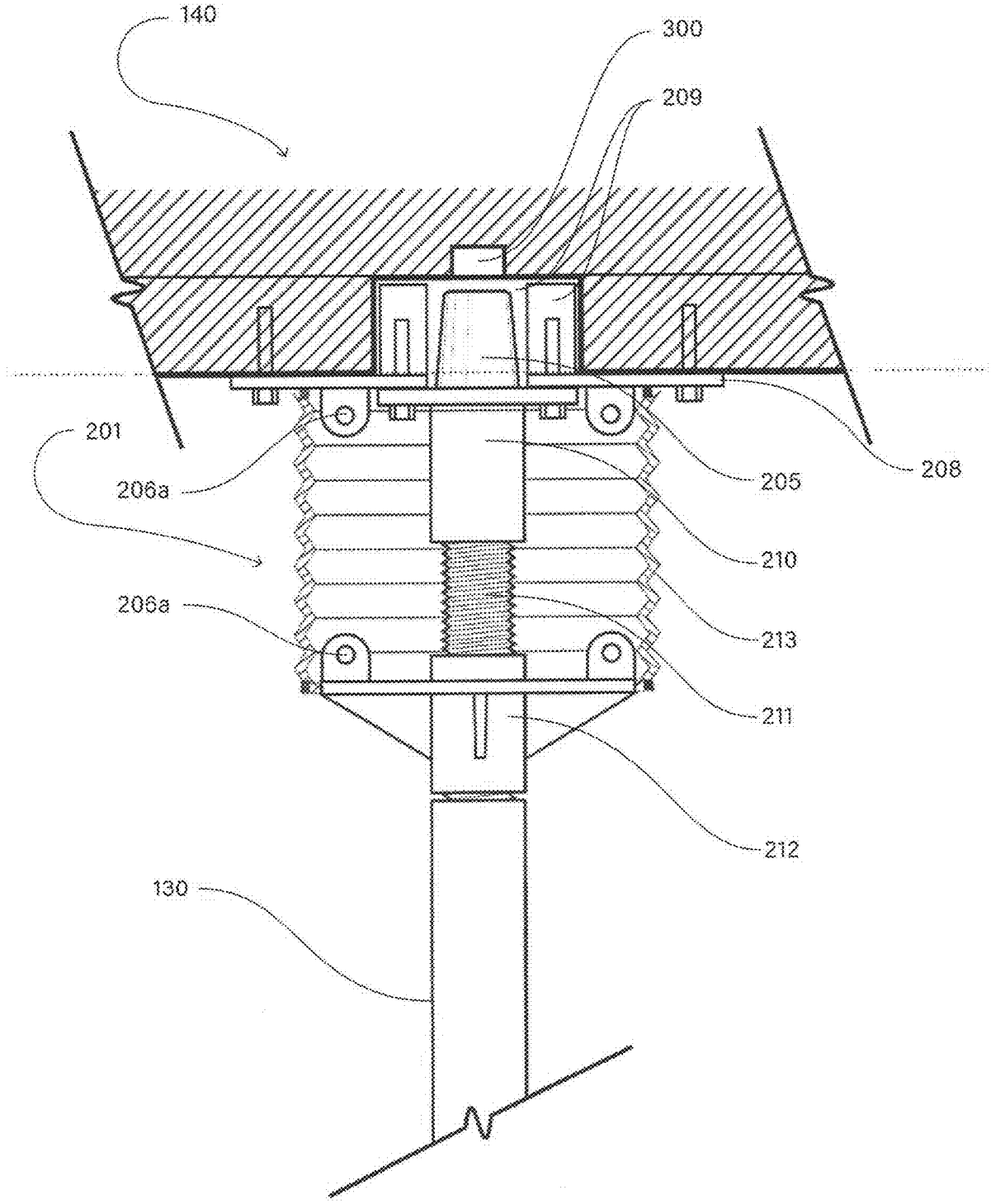
FIG. 5B (series)

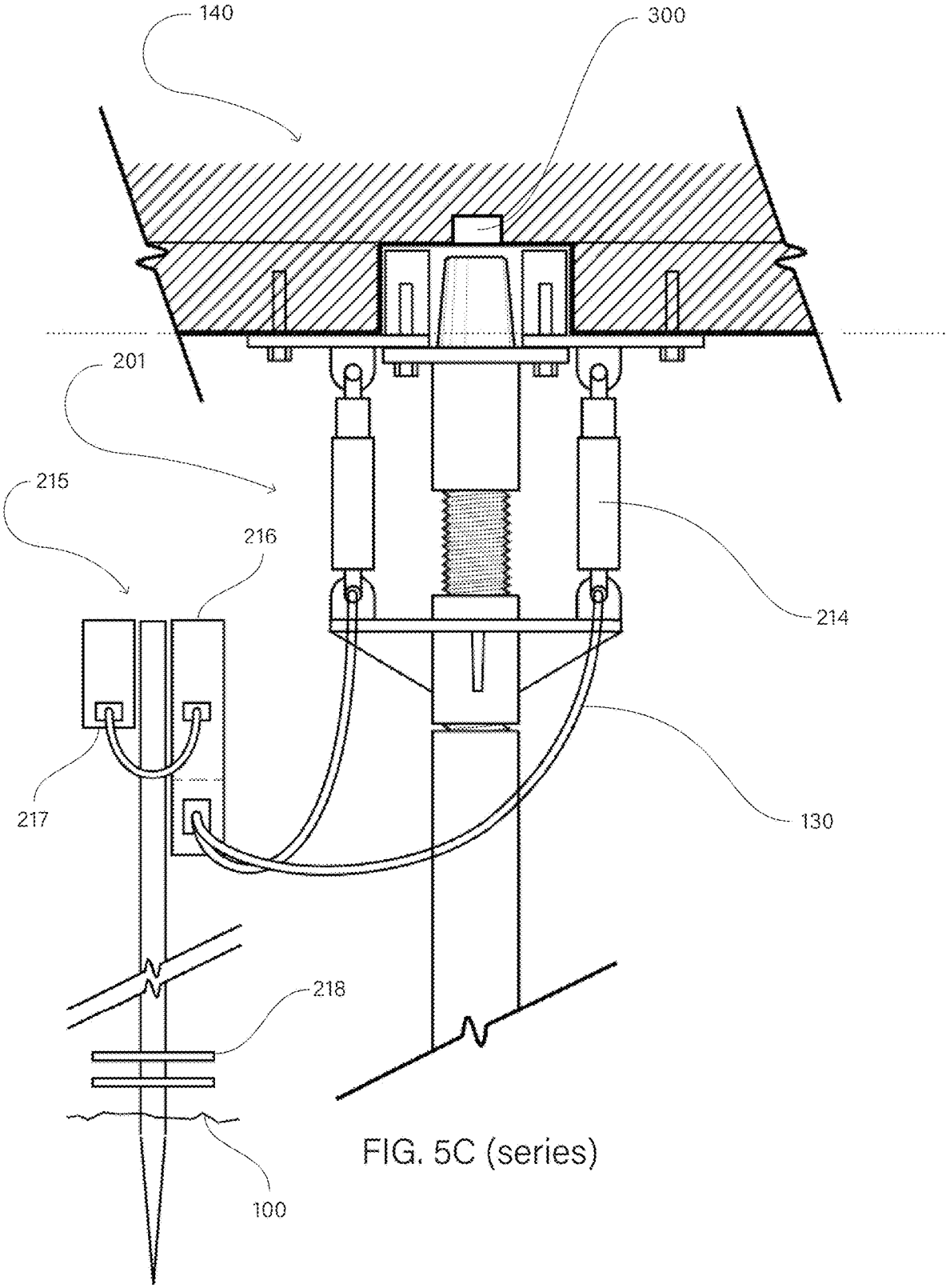
FIG. 5C (series)

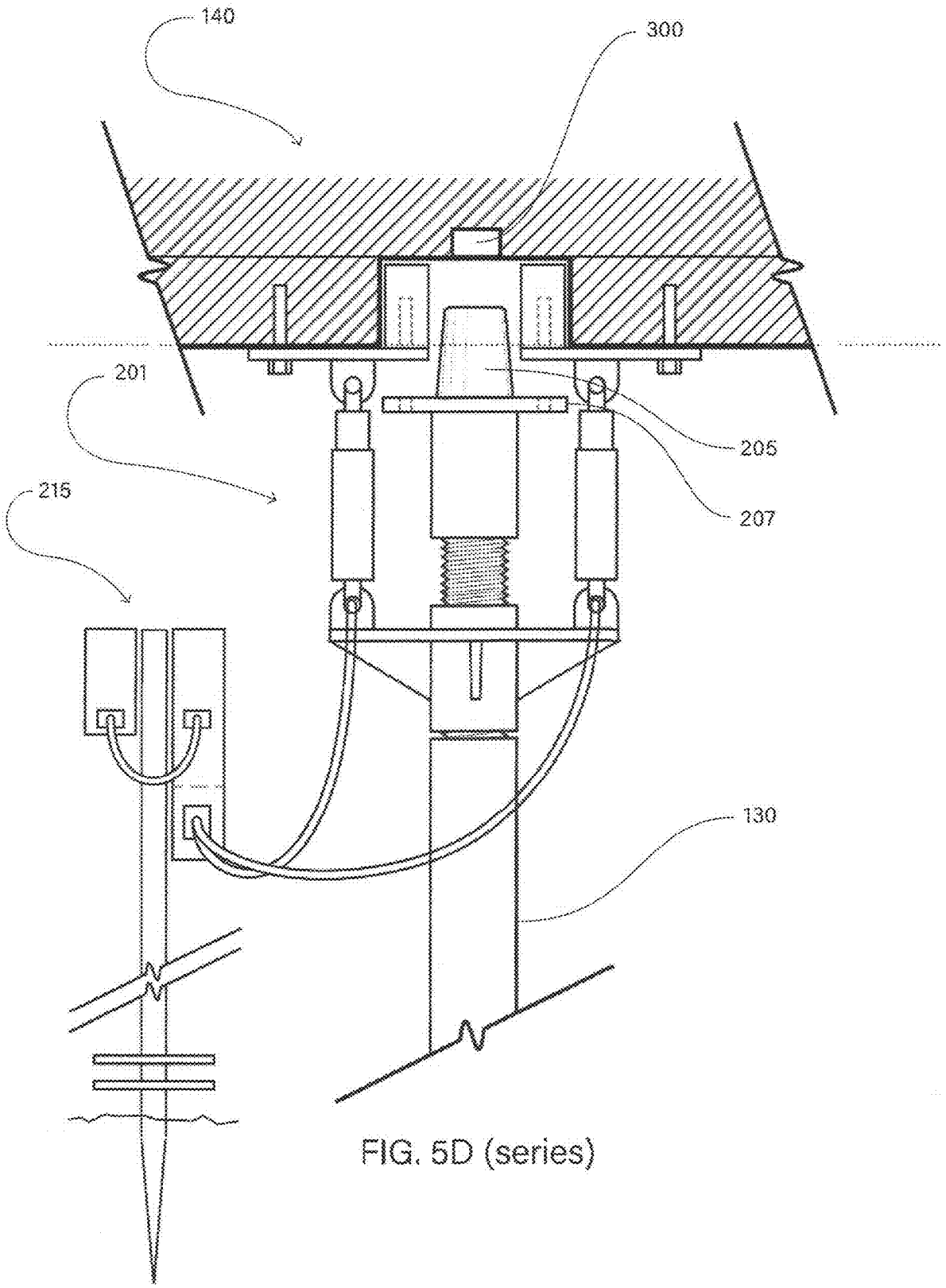
FIG. 5D (series)

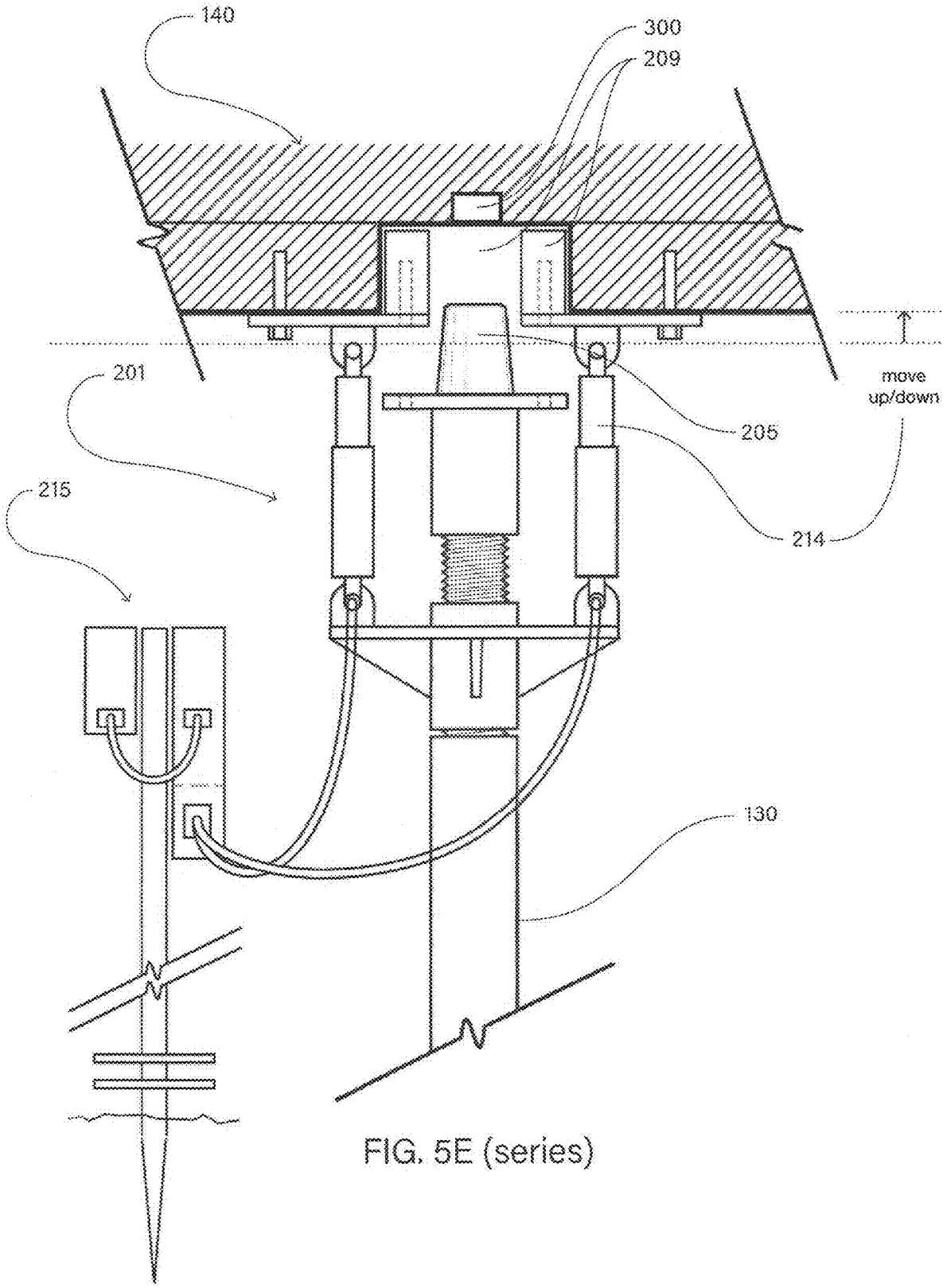
FIG. 5E (series)

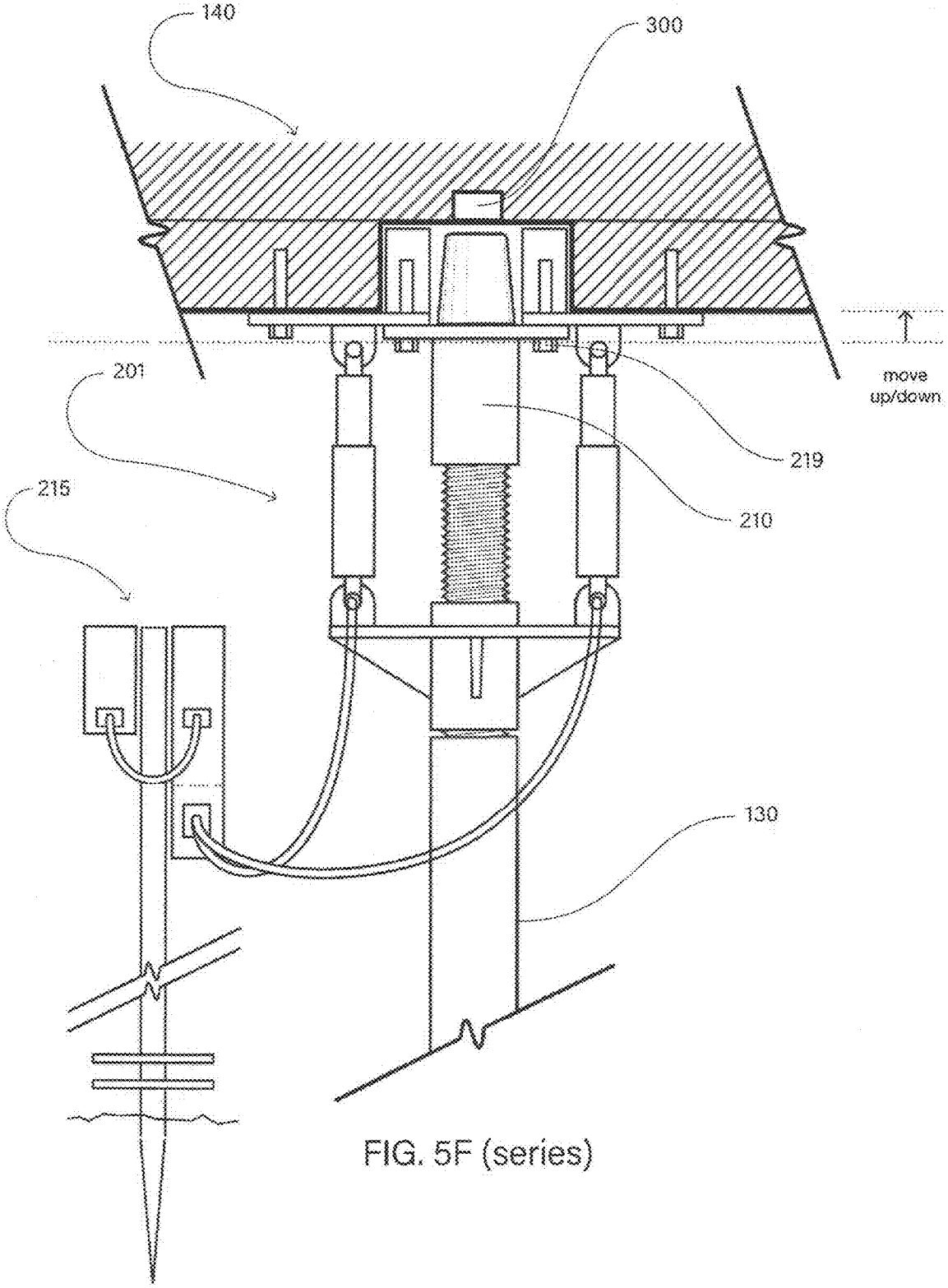
FIG. 5F (series)

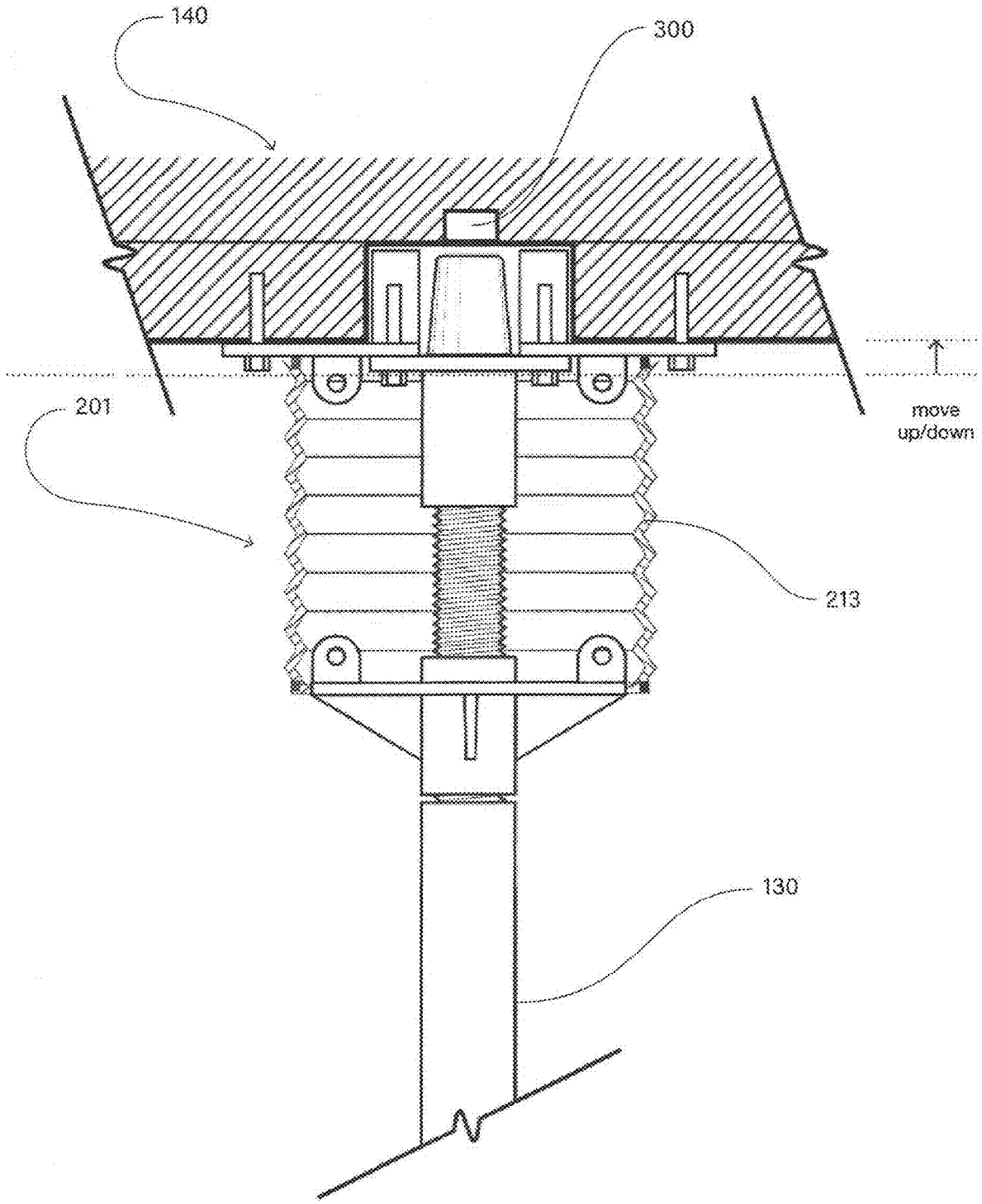
FIG. 5G (series)

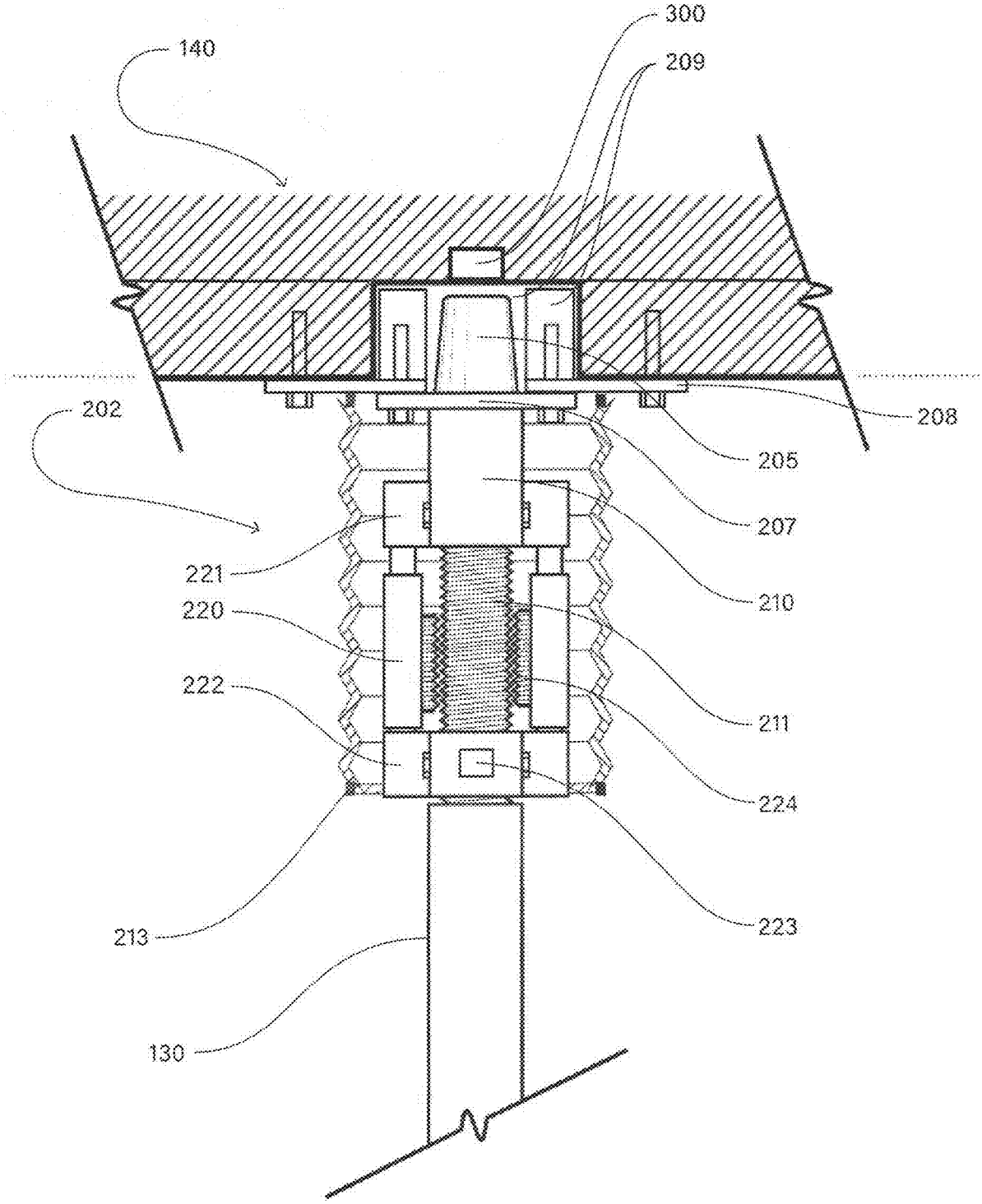
FIG. 7B (series)

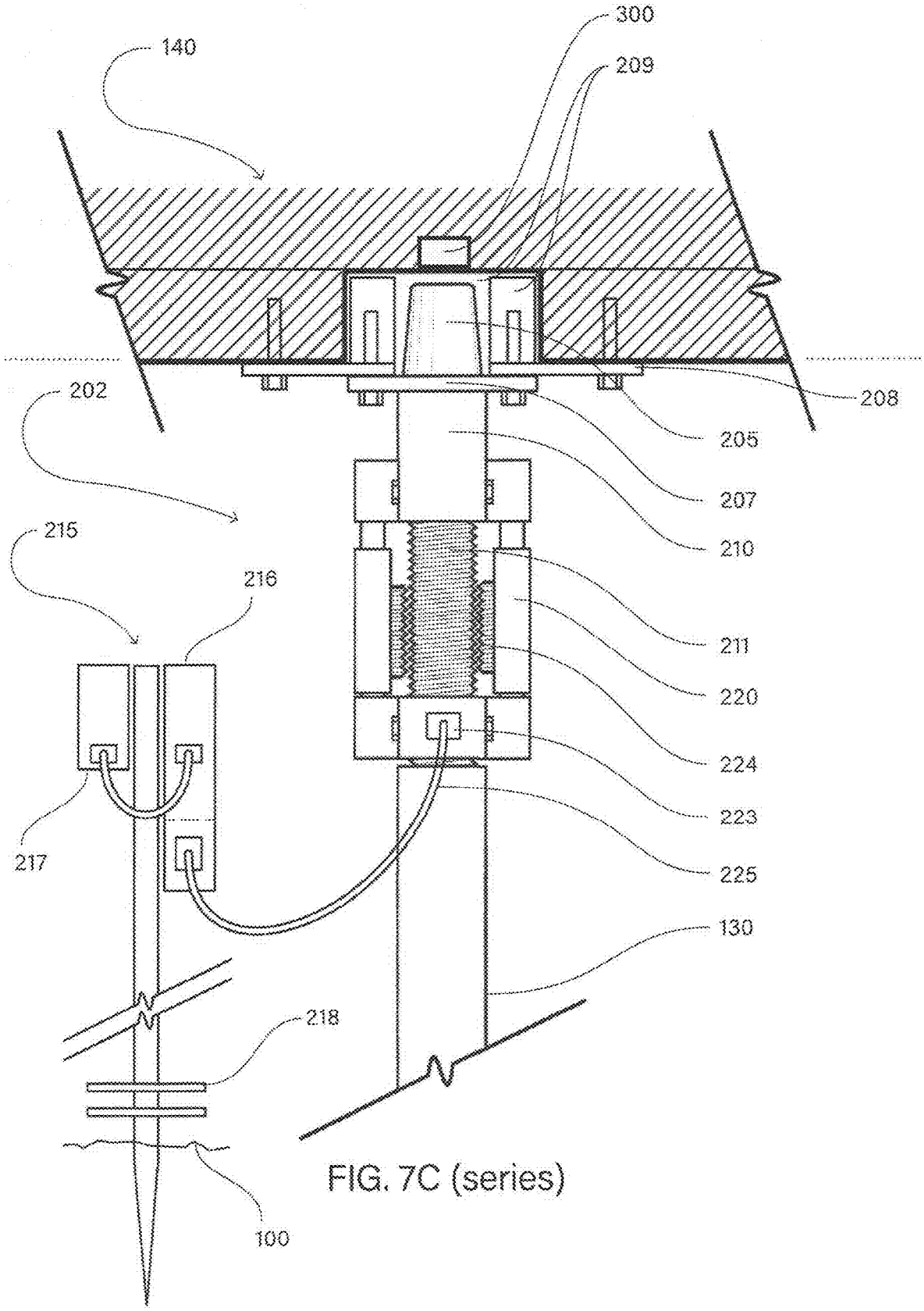
FIG. 7C (series)

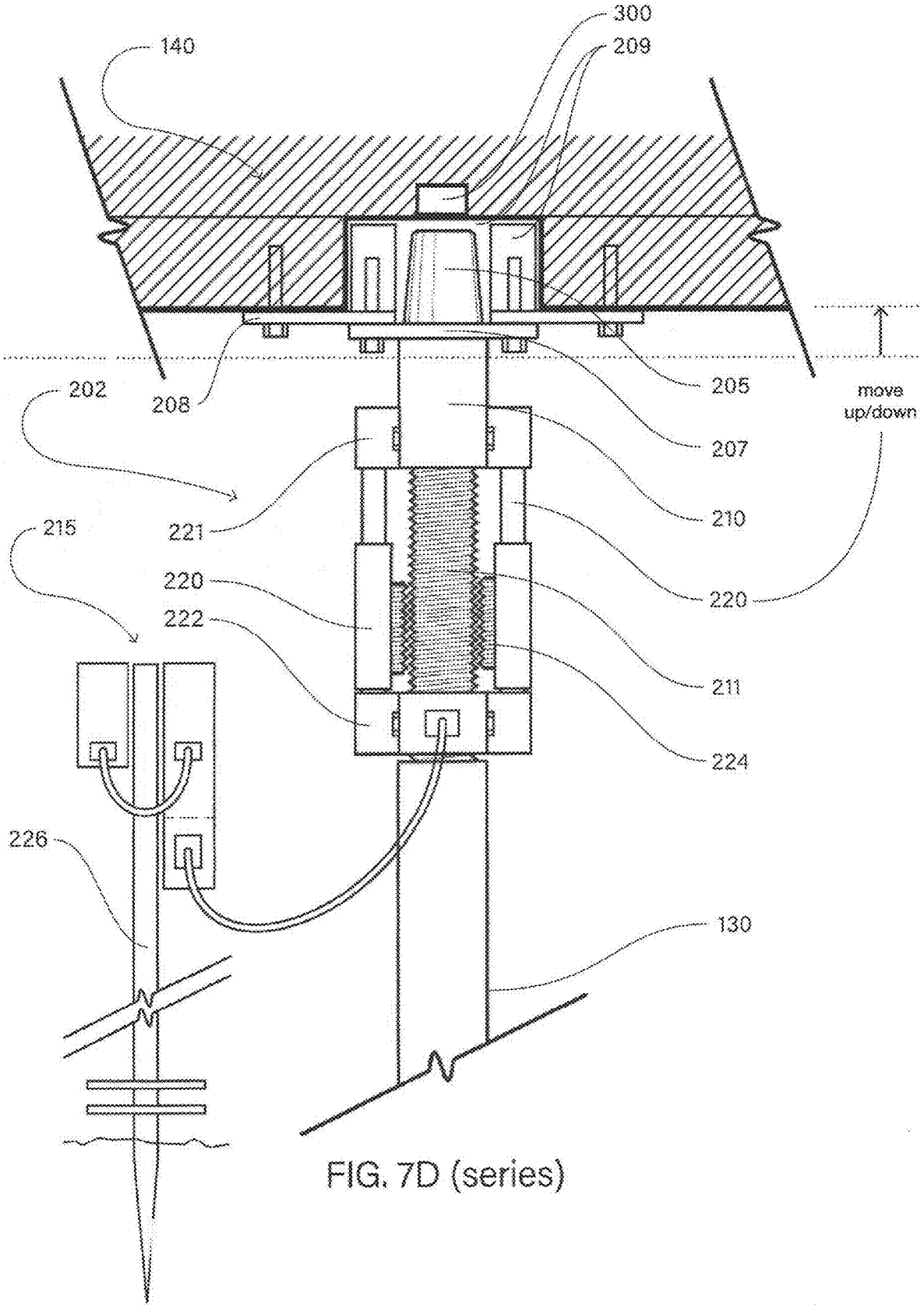
FIG. 7D (series)

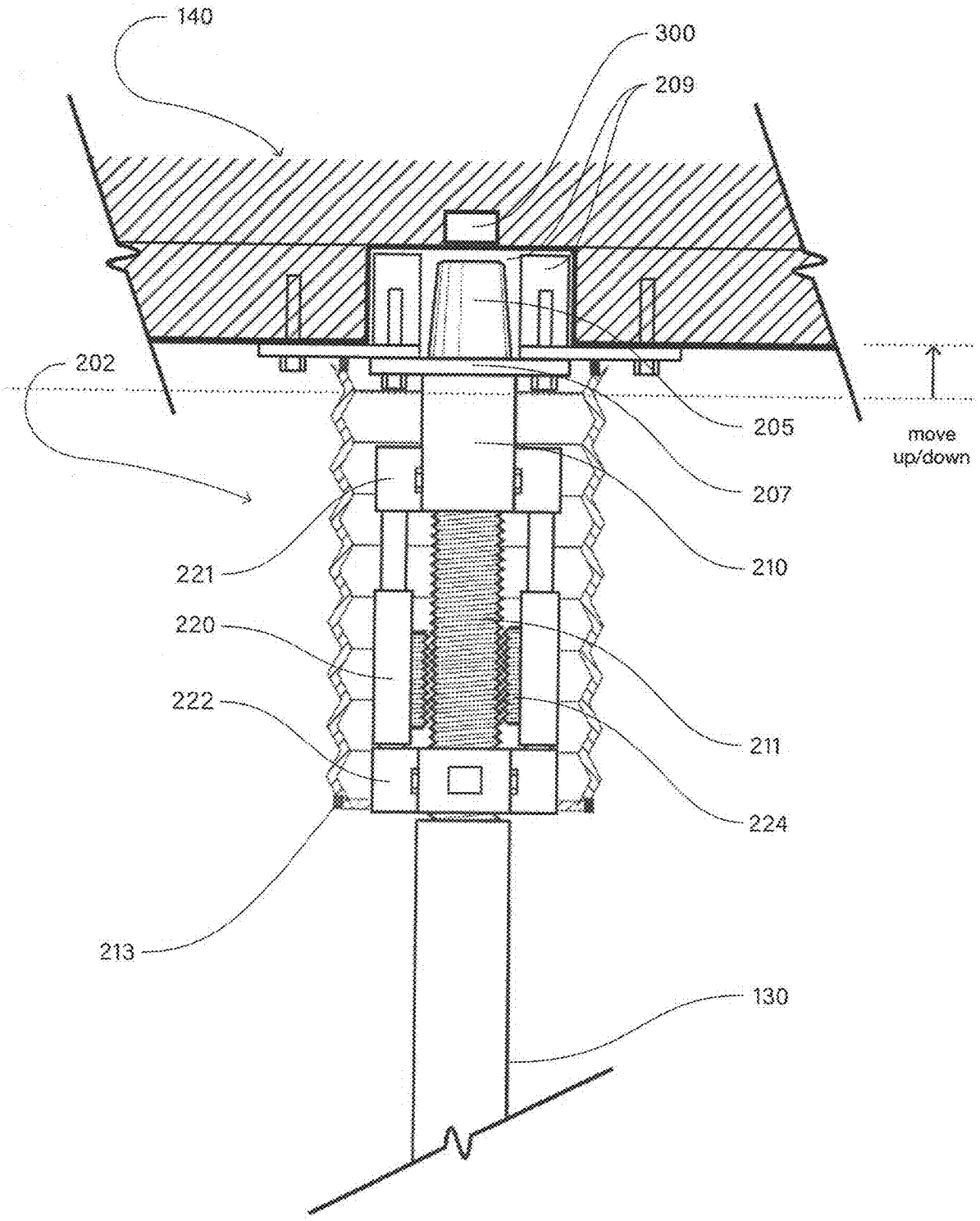
FIG. 7E (series)

INTEGRATED FOUNDATION LEVELING SYSTEM

CROSS-REFERENCE TO RELATED CASES

This application claims priority to U.S. Provisional Application No. 63/498,244, entitled "Integrated Foundation Leveling System, filed Apr. 25, 2023, which is hereby incorporated by reference.

BRIEF SUMMARY

In embodiments, a system monitors, detects and alerts of building foundation settlement due to permafrost, soil or sand subsidence and provides an actuator-based solution to re-set structures in need of lifecycle correction and/or re-leveling, with some embodiments including an integrated internet of things (IoT) and mechanical system.

BRIEF DESCRIPTION OF THE DRAWINGS

The embodiments are illustrated by way of example and not limitation in the figures of the accompanying drawings, in which like references indicate similar elements, and in which:

FIG. 5B is a side cross-sectional view illustrating aspects of an embodiment of a foundation leveling system with a removable actuator and step 1 of an adjustment process;

FIG. 5C is a side cross-sectional view illustrating aspects of an embodiment of a foundation leveling system with a removable actuator and step 2 of an adjustment process;

FIG. 5D is a side cross-sectional view illustrating aspects of an embodiment of a foundation leveling system with a removable actuator and step 3 of an adjustment process;

FIG. 5E is a side cross-sectional view illustrating aspects of an embodiment of a foundation leveling system with a removable actuator and step 4 of an adjustment process;

FIG. 5F is a side cross-sectional view illustrating aspects of an embodiment of a foundation leveling system with a removable actuator and step 5 of an adjustment process;

FIG. 5G is a side cross-sectional view illustrating aspects of an embodiment of a foundation leveling system with a removable actuator and step 6 of an adjustment process;

FIG. 7 is a side cross-sectional view illustrating aspects of an embodiment of a foundation leveling system with a permanent actuator;

FIG. 7B is a side cross-sectional view illustrating aspects of an embodiment of a foundation leveling system with a permanent actuator and step 1 of an adjustment process;

FIG. 7C is a side cross-sectional view illustrating aspects of an embodiment of a foundation leveling system with a permanent actuator and step 2 of an adjustment process;

FIG. 7D is a side cross-sectional view illustrating aspects of an embodiment of a foundation leveling system with a permanent actuator and step 3 of an adjustment process;

FIG. 7E is a side cross-sectional view illustrating aspects of an embodiment of a foundation leveling system with a permanent actuator and step 4 of an adjustment process;

DETAILED DESCRIPTION

Apparatus Descriptions

Figure 1A:
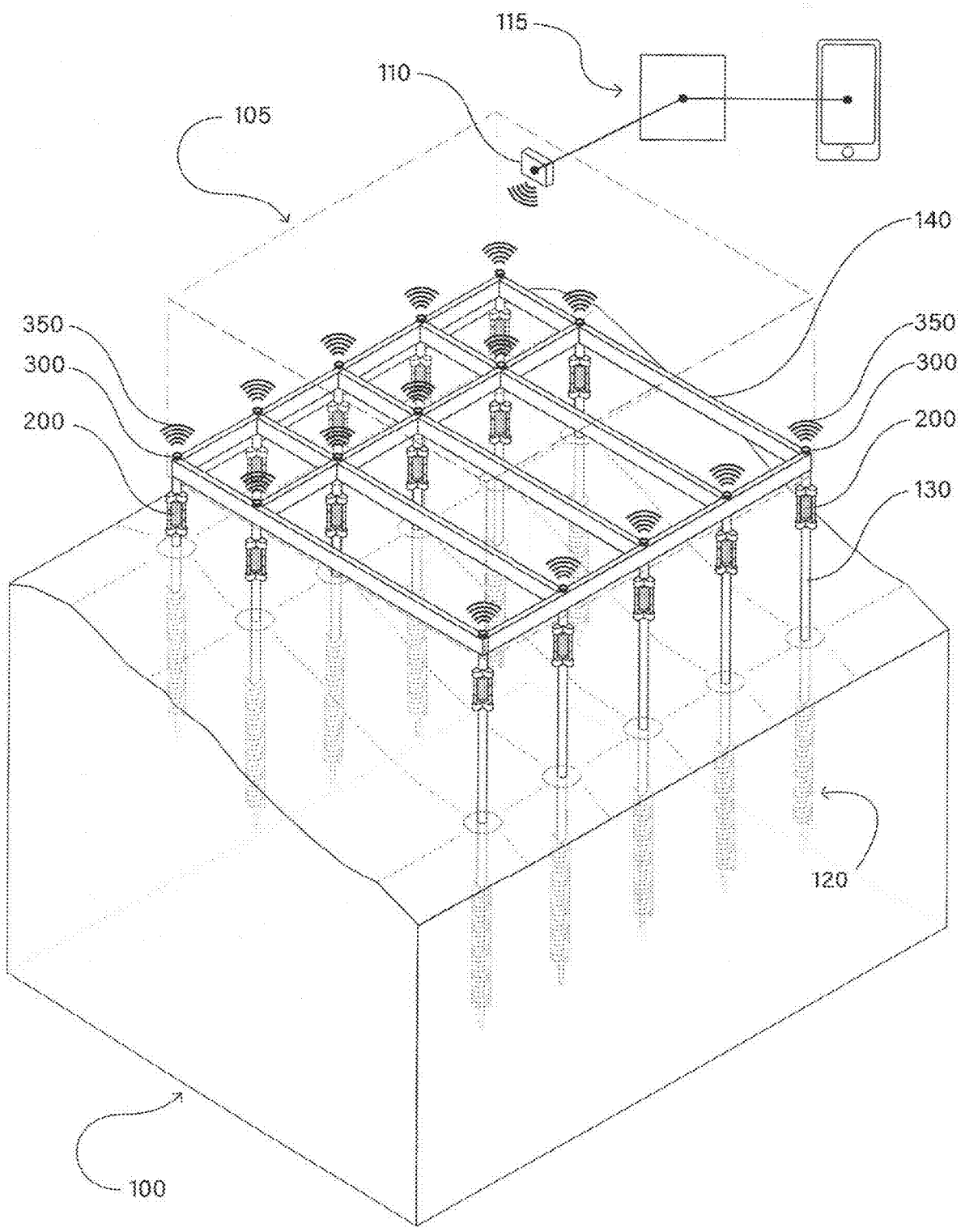
FIG. 1A is a perspective view illustrating an embodiment of a foundation leveling system.

FIG. 1A is a perspective view illustrating an embodiment of a foundation leveling system including elements 110, 115, 200, 300, and 350.

Element 100: A site condition that qualifies as a use case for embodiments of the foundation leveling system in which settlement or differential settlement is likely to occur once a structure is erected.

Element 105: A structure, varies by others, with foundation leveling system incorporated.

Element 110: A site installed system that receives reporting data from sensor stacks located at one, many, or each column position in a build.

Element 115: A cloud computing system (hardware and software) that can communicate with a site installed system (s), run an analysis program that compares data sets and can publish results back to the site installed system(s) and to an application dashboard, and send notifications by email and push notifications (whether in-app or by text messaging services).

Element 120: An in-ground foundations system element (type may vary).

Element 130: A type of structure-supporting column that may be prepared to incorporate adjustment hardware as part of the foundation leveling system allowing for adjustment of the height and location of the top of column position(s).

Element 140: A type of structural frame and/or diaphragm system that may be either the sub-floor system of an occupiable and/or usable structure or a system platform onto which a variety of occupiable and/or usable structures may be installed/mounted/anchored.

Element 200: A generalized type of actuator-driven foundation adjustment hardware contemplated by this application that may be either removable, permanent, or permanent geared (for heavy duty applications).

Element 300: A type of sensor stack that may include one or multiple sensors that can report on one or more of: physical location, acceleration, inclination, deformation, stress and assigned ID, and include communications and power elements. A sensor stack is installed proximate and relative to the top of structure supporting column location.

Element 350: A symbol indicating the ability for a system element to communicate over a wireless protocol such as Wi-Fi or Bluetooth.

Figure 1B:
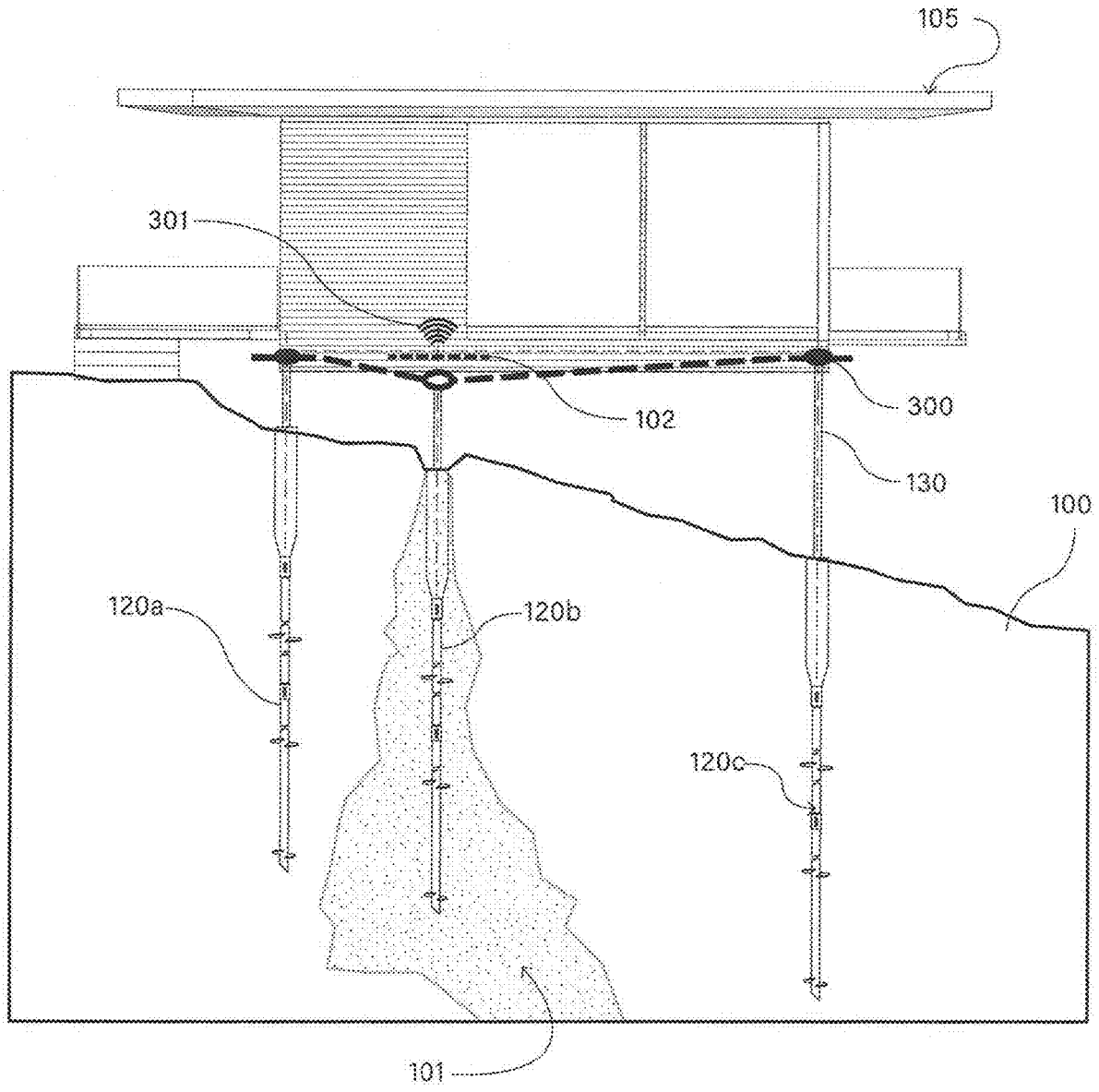
FIG. 1B is a side view illustrating an embodiment of a foundation leveling system.

FIG. 1B is a side view illustrating an embodiment of a foundation leveling system.

Element 101: Area of described sub-grade, post-build settlement that may affect foundation alignment Element 102: Outcome in the change in the contemporary x, y and z position of a foundation based on sub-grade settlement or other causes. Line 102 represents where the foundation top-of column was at time of original installation as compared to a settled condition as shown in FIG. 1B where the column has dropped below that original line causing the sensor to alert the system. The settled condition is shown, the illustration shows a difference between the original installed position and the contemporary position that would cause the sensor alarm to sound.

Element 301: An example of a sensor stack reporting an actionable change in position at the structure-supporting column position it is associated with. The actionable change reported is the change in sensor height from the initial heights (the dashed line connecting the two peripheral columns) to the position indicated by element 301.

Figure 5:
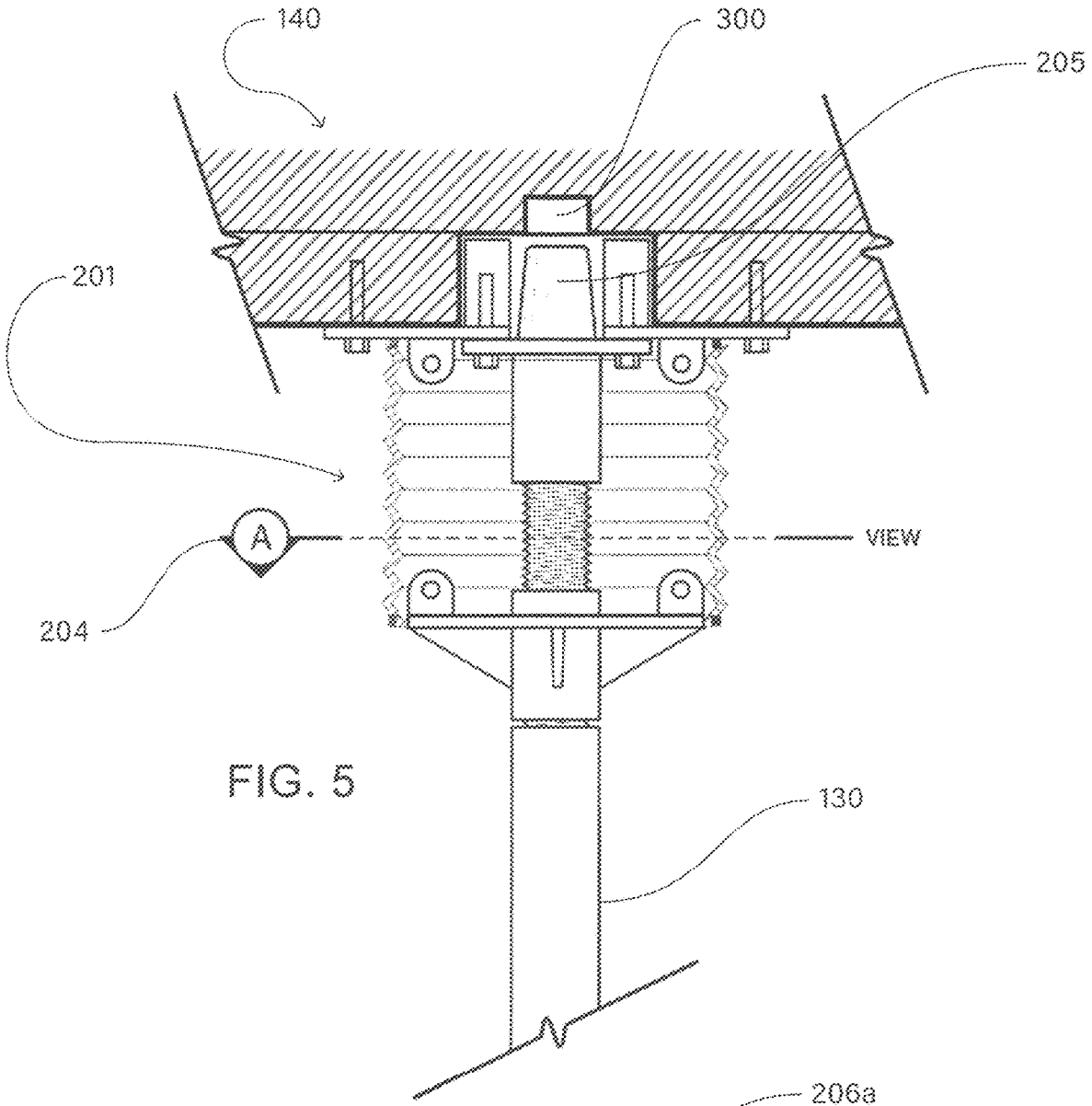
FIG. 5 is a side cross-sectional view illustrating aspects of an embodiment of a foundation leveling system with a removable actuator.

FIG. 5 is a side cross-sectional view illustrating aspects of an embodiment of a foundation leveling system including elements 110, 115, 201, 300, and 350, with a removable actuator 201.

Element 201: A type of actuator-driven foundation adjustment hardware that involves the permanent installation of prepared attachment points for a removable actuator-driven toolkit for field adjustment in place. Toolkit in this instance includes both actuators and a power, computing, communications and drive pack (see FIG. 5C) that is temporarily installed proximate to the system for ease of connection and removal.

Element 204: Drawing convention, a section cut line in the orthogonally projected elevation drawing referring to a plan section of the same three-dimensional concept represented in FIG. 5A.

Element 205: A type of truncated cone column cap of varying dimensions that both allows a structure-supporting column to be guide-seated into the column cavity of the structure and also limits the x, y movement of the same structure-supporting column relative to the column cavity when the column is backed away from the structure to prevent a shift in registration relationship beyond acceptable tolerance.

Figure 5A:
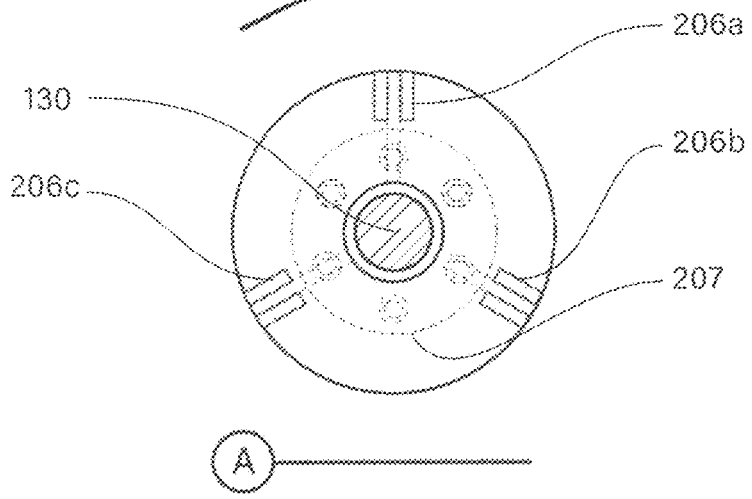
FIG. 5A is a top view of the section indicated in FIG. 5.

FIG. 5A is a top view of the section indicated in FIG. 5.

Element 206: A type of mounting attachment that accepts the installation of removable actuators-quantity may vary based on the scale of the build. In the embodiment, the actuator(s) rotate element 207 (see also element 212 (FIG. 5B)) with respect to element 140 to adjust the height of element 140.

Element 207: A type of structural mounting plate that contemplates the use of fasteners to connect the structure-supporting column assembly to the structure, (see 140).

FIG. 5B-FIG. 5G are side cross-sectional views illustrating aspects of an embodiment of a foundation leveling system with a removable actuator, each illustrating a step of an adjustment process. FIG. 5B illustrates step 1 of an adjustment process: the initial attached state of the adjustable foundation/building connection.

Element 208: A type of structural mounting plate that contemplates the use of fasteners allowing the structure-supporting column assembly to be received by the structure, (see 140).

Element 209: A type of structural mounting cavity that accepts both the guide-positioned structure-supporting column truncated cone top-most element and a cavity frame surround fabrication with machine threaded receptacles to accept the attachment of fasteners from the assembly below.

Element 210: Adjustable column section that travels over a threaded structural column.

Element 211: Threaded structural column sized appropriately so as to satisfy the structural engineering demands of the build.

Element 212: A type of permanently installed rotatable mounting element that allows for adjustment so that the top and bottom attachment points of the actuators (when installed) can be perfectly aligned.

Element 213: A type of removable bellows boot that allows the adjustable assembly constrained within its surround to be protected from moisture, salt and airborne dust/dirt/debris.

FIG. 5C, FIG. 5D, and FIG. 5E are side cross-sectional views illustrating aspects of an embodiment of a foundation leveling system with a removable actuator and steps 2, 3, and 4, respectively, of an adjustment process.

Element 214: A type of removable actuator that, in multiple, is able to lift, lower and horizontally reposition a building payload in a controlled and coordinated fashion.

Element 215: A type of power, communications, computing and drive pack that can be temporarily installed on a staked position proximate to the temporarily or permanently installed actuators on their structural assembly for case of connection and removal.

Element 216: A type of interchangeable communications, computing and drive pack (motors) that can be temporarily installed on a staked position.

Element 217: A type of interchangeable power pack that can be temporarily installed on a staked position.

Element 218: A type of stake that can be driven into the ground by foot or simple tools and be held in place with interchangeable ballast.

In FIG. 5C, in step 2, the bellows boot has been removed, the actuators have been installed, and the computing, power, motor and communications components associated with driving the motion of the actuators have been attached via a wiring harness.

In FIG. 5D in step 3, the actuators are controlled by element 215 to apply force to keep the building in place so that it does not settle as the connection between the adjustable foundation and the building are decoupled so that an adjustment may take place. The bolts attaching 207 have been removed and 207 is now lowered by being screwed further down onto the threaded structural column. 205 keeps the structure from shifting laterally while the bolted connection is undone.

In FIG. 5E in step 4, the actuators are controlled by element 215 to lift the structure to a new or restored vertical position with height data being supplied by element 300.

FIG. 5F is a cross-sectional view illustrating aspects of an embodiment of a foundation leveling system with a removable actuator and step 5 of an adjustment process.

Element 219: A type of structural bolt that allows a bolt-together assembly so that foundation adjustments can be made non-destructively to the system components.

In FIG. 5F, in step 5, element 210, which in this embodiment has internal threads that engage corresponding threads on column 211, is rotated to rise up threaded column 211 to raise plate 207 into position so that a secure connection can be re-established to structure 140 at the new location. Bolts 219 are replaced to restore the connection.

FIG. 5G is a side cross-sectional view illustrating aspects of an embodiment of a foundation leveling system with a removable actuator and step 6 of an adjustment process.

In FIG. 5G, in step 6, the actuators and attached computing, power, motor and communications unit are removed and the protective bellows boot is re-installed.

Figure 7A:
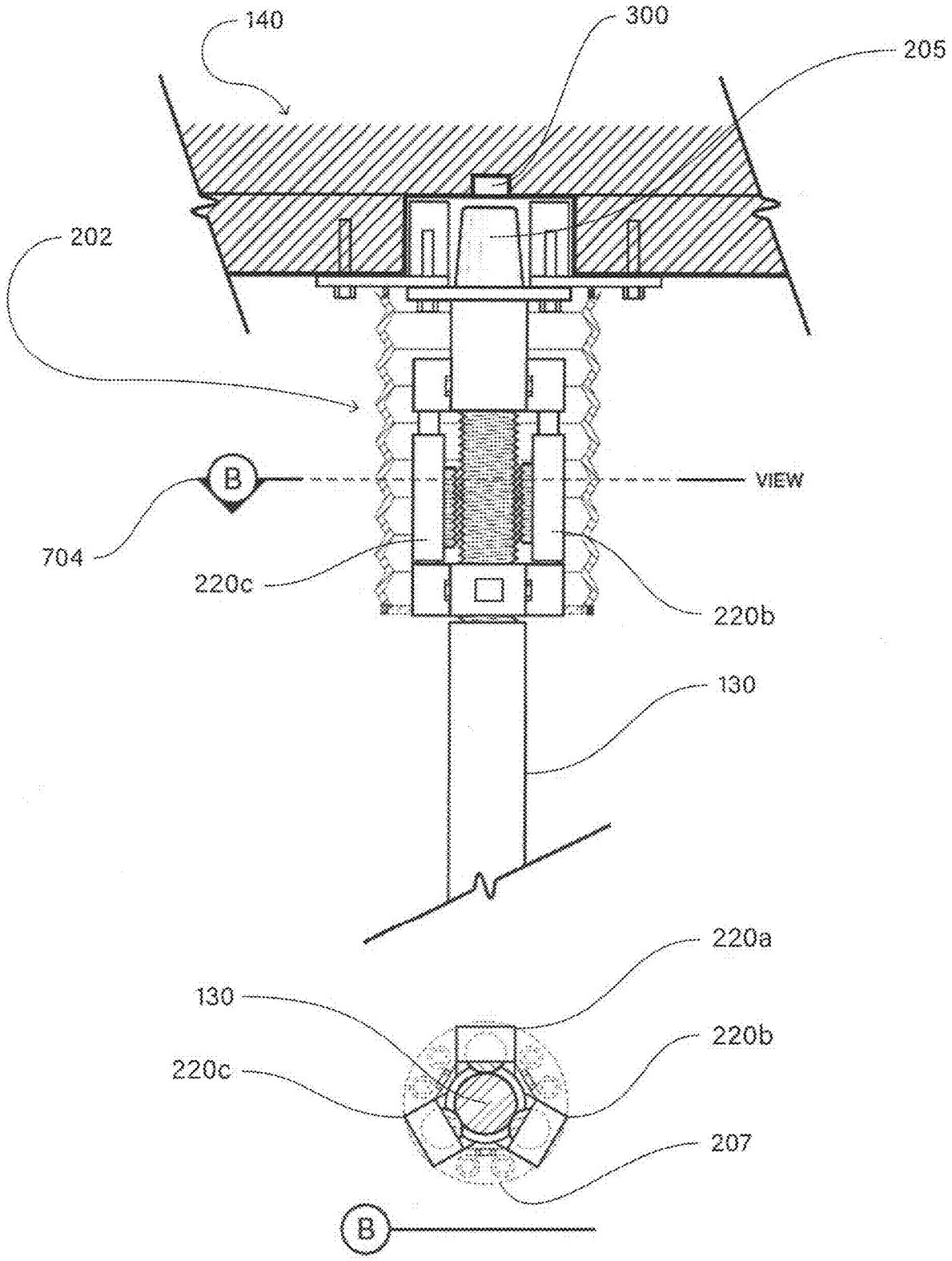
FIG. 7A is a top view of the section indicated in FIG. 7.

FIG. 7 is a side cross-sectional view illustrating aspects of an embodiment of a foundation leveling system including elements 110, 115, 202, 300, and 350 with a permanent actuator 202. FIG. 7A is a top view of the section indicated in FIG. 7 by view cross-section element 704.

Element 202: A type of actuator-driven foundation adjustment hardware that involves the permanent installation of an actuator system for field adjustment of structure supporting columns in place. This actuator system is powered and driven by a power, computing, communications and drive pack that is temporarily installed proximate to the system for case of connection and removal. In an embodiment, a permanently attached power, computing, communications and drive pack may be included.

Element 220: A type of permanently installed actuator that, in multiple, is able to lift, lower and horizontally reposition a building payload in a controlled and coordinated fashion. Element 220 is a type of actuator that is configured such that its own drive rod (threaded) directly engages with the threaded rod of the foundation structure. The turning of this actuator lifts or lowers the adjustable foundation structure. Elements 220*a*, 220*b*, and 220*c* illustrate how several such actuators that directly engage the thread of the adjustable foundation column 211 can be arranged around the adjustable foundation to operate in concert so that smaller actuators can be used to accomplish the desired result. For example, each actuator 220*a*, 220*b*, 220*c* may be controlled to rotate its drive rod so that the drive rod rises or lowers with respect to column 211, thereby raising or lowering the bodies of actuators 220*a*, 220*b*, or 220*c* and element 210.

FIG. 7B-FIG. 7E are side cross-sectional views illustrating aspects of an embodiment of a foundation leveling system with a removable actuator, each illustrating a step of an adjustment process.

FIG. 7B is a side cross-sectional view illustrating aspects of an embodiment of a foundation leveling system with a permanent actuator and step 1 of an adjustment process.

Element 221: A type of permanent mounting of the actuator to the adjustable column section.

Element 222: A type of permanent mounting of the actuator to base of the adjustable section that has an internal conduit for the routing of power and device signal lines to each of any number of possible actuators that are part of the assembly.

Element 223: A type of power and device signal port that allows either a temporary or permanent power, communications, computing and drive pack to be attached to the actuator assembly.

Element 224: A type of direct threaded rod coupling that allows the actuator to drive the position of the threaded structural column (typical to each actuator in the assembled configuration). With threads of actuator column 224 engaging threads of column 211, rotation of actuator column 224 about the z-axis causes threaded column 211 to rise or descend, with element 210 and structure 140 rising or descending accordingly. In this embodiment, element 210 is not internally threaded and may rise or descend upon threaded column 210 without requiring rotation.

FIG. 7B illustrates step 1 of an adjustment process: the initial attached state of the adjustable foundation/building connection.

FIG. 7C is a side cross-sectional view illustrating aspects of an embodiment of a foundation leveling system with a permanent actuator and step 2 of an adjustment process.

Element 225: A type of cable harness that allows power and device signal to be passed to the permanent actuator assembly through a port.

In FIG. 7C, in step 2, the bellows boot has been removed, the actuators have been installed, and the computing, power, motor and communications components associated with driving the motion of the actuators have been attached via a wiring harness.

FIG. 7D is a side cross-sectional view illustrating aspects of an embodiment of a foundation leveling system with a permanent actuator and step 3 of an adjustment process.

Element 226: A type of in-ground stake that allows for the proximate temporary installation of the power, communications, computing and drive pack(s).

In FIG. 7D, in step 3, the actuators are controlled by element 215 to lift the structure to a new or restored vertical position with height data being supplied by element 300. Actuator column 224 is controlled to rotate about the z-axis such that elements 224 climb upwards on column 211, with element 210 and structure 140 rising or descending accordingly. In this embodiment, element 210 is not internally threaded and may rise or descend upon threaded column 210 without requiring rotation.

In FIG. 7E, in step 4, the actuators and attached computing, power, motor and communications unit are removed and the protective bellows boot is re-installed.

Figure 9:
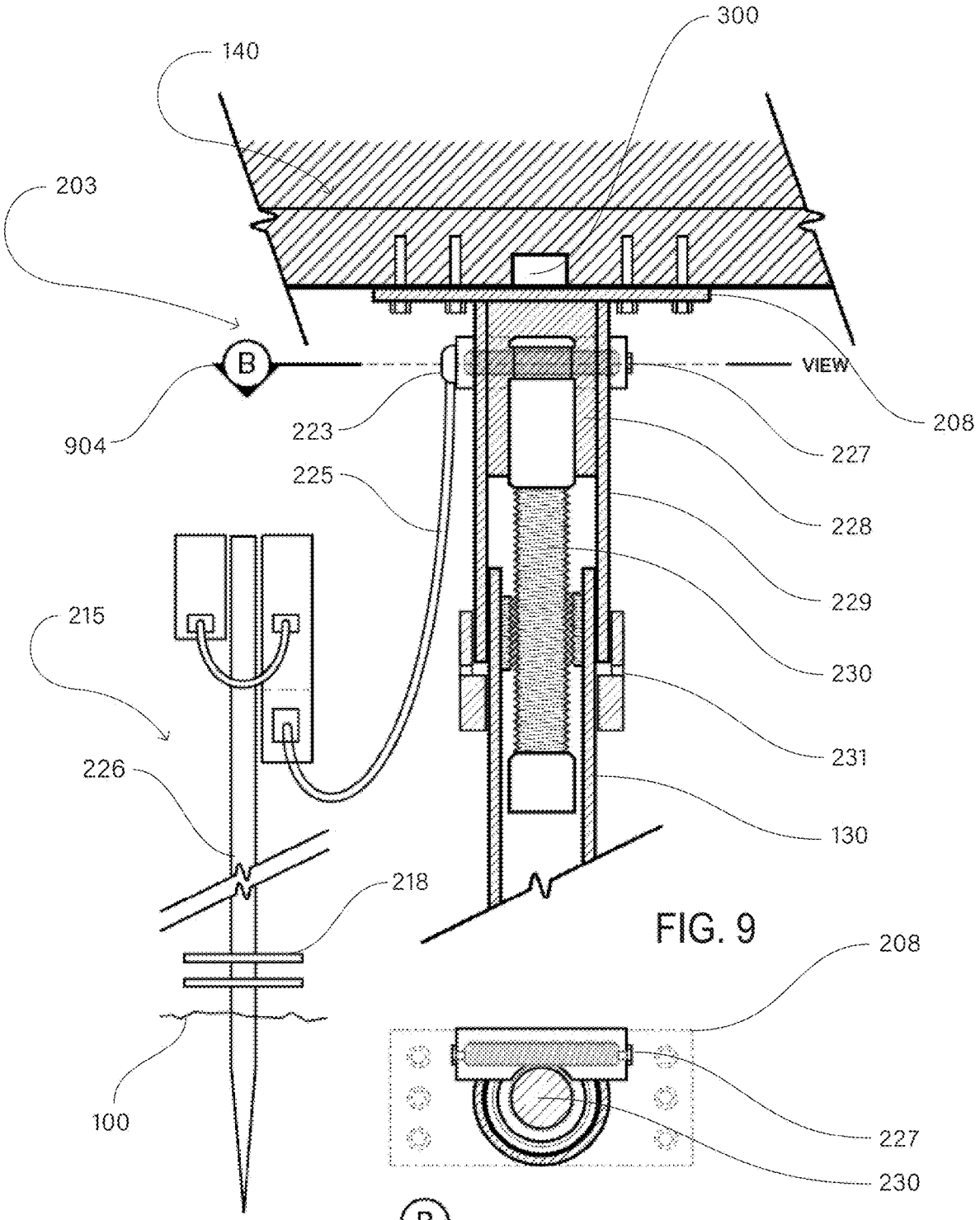
FIG. 9 is a side cross-sectional view illustrating aspects of an embodiment of a foundation leveling system with a permanent geared actuator.
Figure 9A:
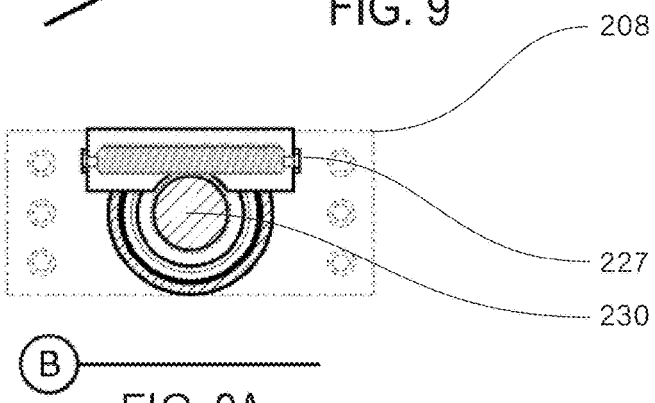
FIG. 9A is a top view of the section indicated in FIG. 9.

FIG. 9 is a side cross-sectional view illustrating aspects of an embodiment of a foundation leveling system including elements 110, 115, 203, 300, and 350, with a permanent geared actuator 203. FIG. 9A is a top view of the section indicated in FIG. 9.

Element 203: A type of actuator-driven foundation adjustment hardware that involves the permanent installation of an actuator system for field adjustment in place. This actuator system is arranged so that the actuator drives may engage the adjustable structure through a geared interface, allowing this iteration of the system to address the needs of larger builds with a greater per square foot payload. In this embodiment, worm-drive actuator 227 is controlled to rotate threaded column 230 about the z-axis to raise or lower element 229 with respect to element 130, thereby raising or lowering structure 140. This actuator system is powered and driven by a power, computing, communications, and drive pack that is temporarily installed proximate to the system for ease of connection and removal. In an embodiment, a permanently attached power, computing, communications, and drive pack may be included.

Element 904: Drawing convention, a section cut line in the orthogonally projected elevation drawing referring to a plan section of the same three-dimensional concept represented in FIG. 9A.

Element 227: A type of actuator(s) related to the adjustment axis to allow for a geared interface to allow smaller actuators to lift/lower heavier structural payloads in a controlled and precise manner. Quantity of applied actuators operating in synchrony may vary.

Element 228: An internal structural receiving bracket with a reduced opening to fit, and structurally secure, the topmost portion of a threaded steel structural column.

Element 229: A type of outer movable sleeve over column support that encases the drive mechanism as an alternative to a bellows boot assembly in cases where the installation location, scale or accessibility of the installation merits a solution that minimizes maintenance requirements and allows adjustment to occur without the physical preparation and resetting steps outlined in the standard operating procedures presented elsewhere for Temporary and Permanent actuator assembly operation.

Element 230: A type of threaded structural column sized appropriately so as to satisfy the structural engineering demands of the build that is contained entirely within a fixed and movable sleeve assembly.

Element 231: A type of surround clamp that can be tightened around the overlap junction of the fixed and movable sleeve outer columns to achieve a functional weather and debris barrier. Clamp to be designed to include lubrication ports for the internal assembly.

Method Descriptions

Figure 2A:
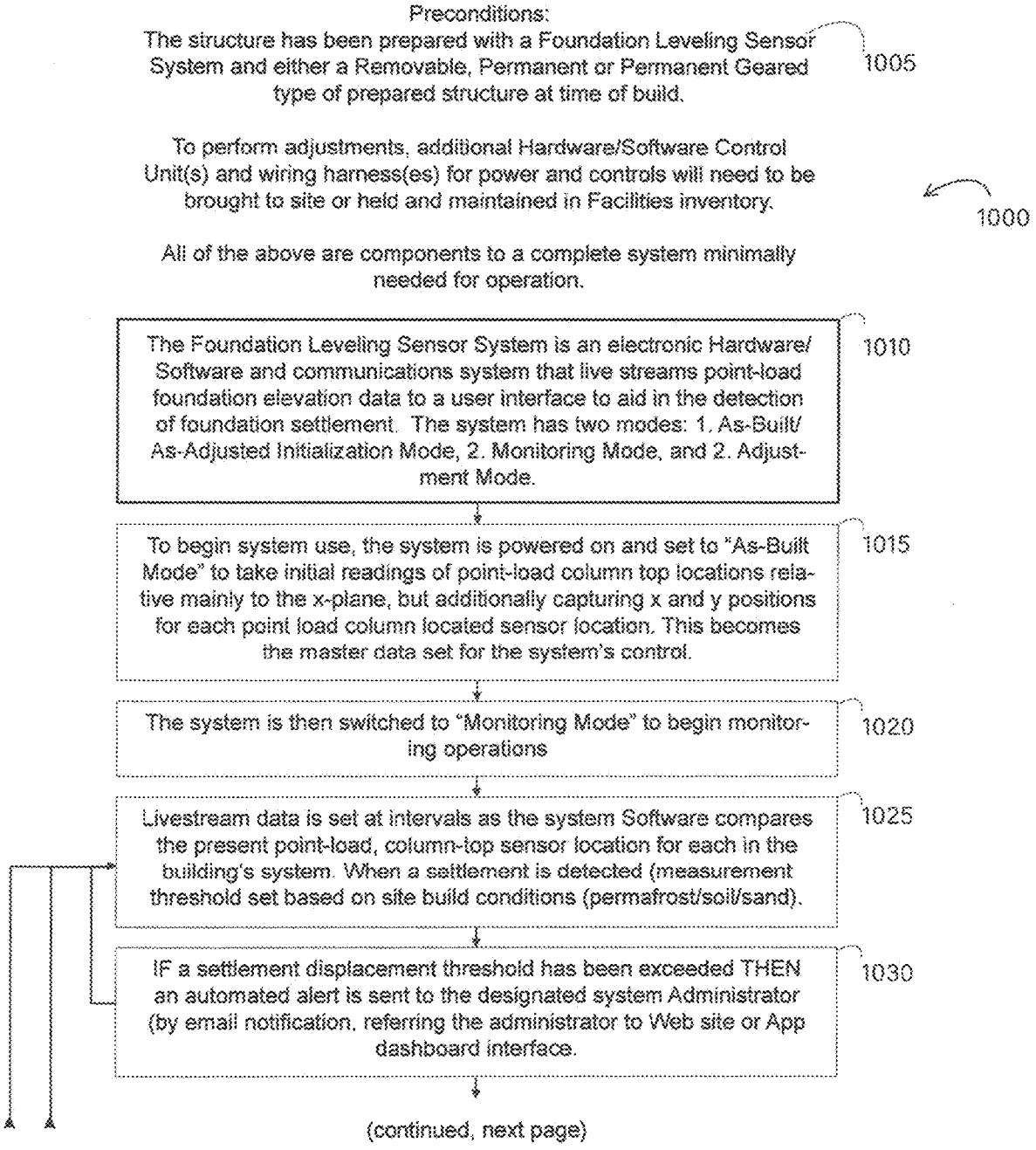
FIG. 2A is a flowchart illustrating an embodiment of a method of a foundation leveling system.
Figure 2B:
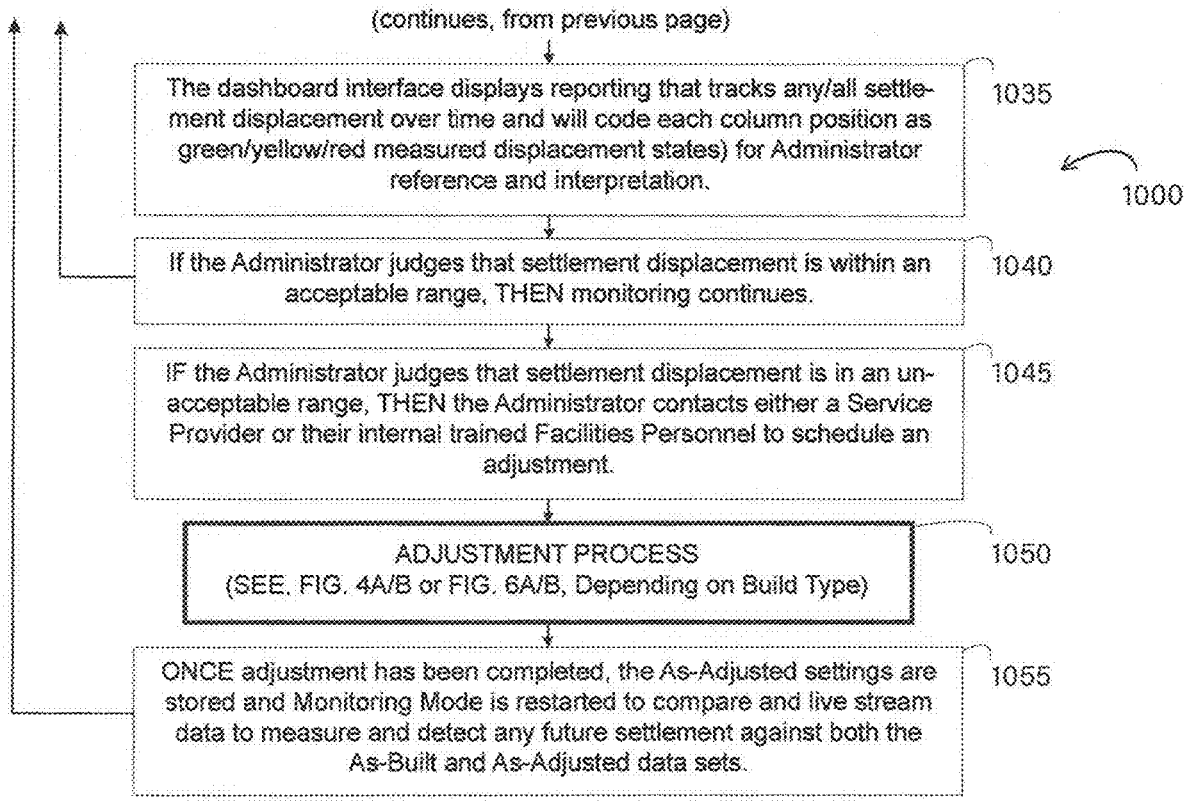
FIG. 2B is a continuation of FIG. 2A.

FIG. 2A and FIG. 2B contain a flowchart illustrating an embodiment of a method of using a foundation leveling system.

Method 1000: FLOWCHART Monitoring and Detection Cycle

Preconditions 1005: The structure has been prepared with a foundation leveling sensor system and either a removable, permanent or permanent geared type of prepared structure at time of build. To perform adjustments, additional hardware/software control unit(s) and wiring harness(es) for power and controls are brought to site or held and maintained in facilities inventory.

Description 1010: In an embodiment, the foundation leveling sensor system is an electronic hardware/software and communications system that live streams point-load foundation elevation data to a user interface to aid in the detection of foundation settlement. The system has three modes: 1. As-built/as-adjusted initialization mode, 2. Monitoring mode, and 3. Adjustment mode.

Step 1015: To begin system use, the system is powered on and set to "As-Built Mode" to take initial readings of point-load column top locations relative mainly to the x-plane, but additionally capturing x and y positions for each point load column located sensor location. This becomes the master data set for the system's control.

Step 1020: The system is then switched to "Monitoring Mode" to begin monitoring operations Step 1025: Livestream data is set at intervals as the system software compares the present point-load, column-top sensor location for each in the building's system. When a settlement is detected (measurement threshold set based on site build conditions (permafrost/soil/sand)) the method proceeds to step 1030.

Step 1030: IF a settlement displacement threshold has been exceeded THEN an automated alert is sent to the designated system administrator (by email notification, referring the administrator to web site or App dashboard interface).

Step 1035: The dashboard interface (e.g., part of element 115) displays reporting that tracks any/all settlement displacement over time and will code each column position as green/yellow/red measured displacement states) for Administrator reference and interpretation.

Step 1040: If the Administrator judges that settlement displacement is within an acceptable range, THEN monitoring continues.

Step 1045: IF the Administrator judges that settlement displacement is in an unacceptable range, THEN the Administrator contacts either a Service Provider or their internal trained Facilities Personnel to schedule an adjustment.

Step 1050: ADJUSTMENT PROCESS (see, FLOWCHART 3000, 4000 or 5000, depending on build type)

Step 1055: ONCE adjustment has been completed, the As-Adjusted settings are stored and Monitoring Mode is restarted to compare and live stream data to measure and detect any future settlement against both the As-Built and As-Adjusted data sets.

Figure 3:
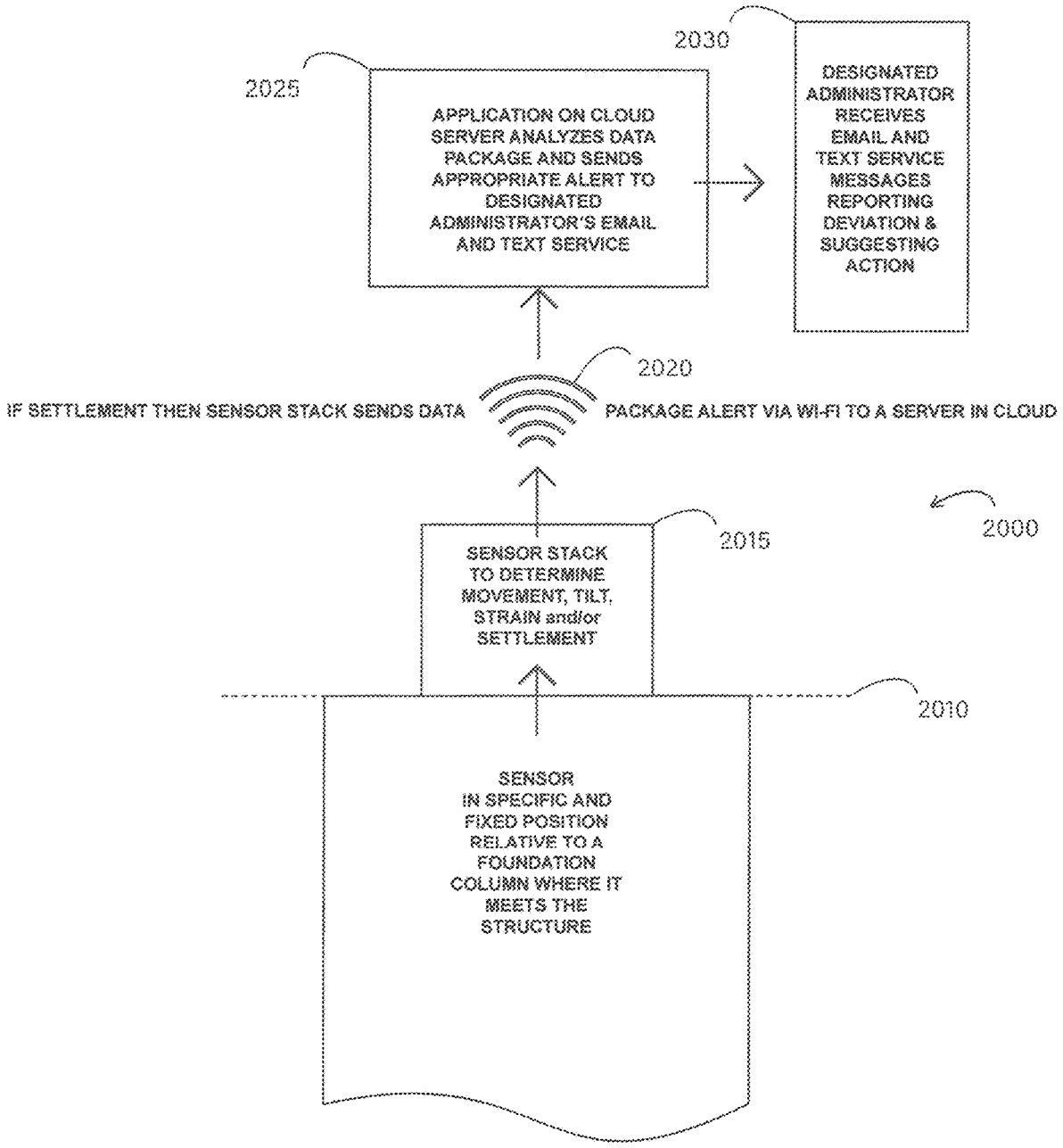
FIG. 3 is a diagram of components of an embodiment of a foundation leveling system that participate in monitoring, detection, and alert function.

FIG. 3 is a diagram of the use of components of an embodiment of a foundation leveling system that participate in monitoring, detection, and alert function.

Method 2000: FLOWCHART An Object-Flowchart of the Alert Procedure

Step 2010: Sensor in specific and fixed position relative to a foundation column where it meets the structure.

Step 2015: Data from sensor stack is received or monitored and analyzed to detect movement, tilt, strain and/or settlement. In some embodiments, a sensor stack may send data only after a threshold event, e.g., a deviation from an initial position, has been reached.

Step 2020: IF settlement THEN sensor stack sends data package alert via wi-fi to a server in cloud.

Step 2025: Application on cloud server analyzes data package and sends appropriate alert to designated administrator's email and text service.

The data package includes readings from each of the sensor stack functions (including, but not limited to: physical location, acceleration, inclination, deformation, stress and assigned ID). This package, presented as livestream data, represents the "contemporary" state of the foundation which is to be compared to the stored "as-built" state data for each sensor stack/column position. Where there is a difference in these data sets, the software algorithm determines whether or not if the deviation is significant enough to warrant sending an alert, or if it is negligible enough to continue to track the deviation by keeping a time-based record that can represent the settlement changes over time. This time-based record is then used as an additional input in the alert decision flowchart with the ability to alert the administrator if the rate of change, more so than the measured deviance, becomes actionable data. Thresholds may be pre-set for both the deviation and the rate of change of the deviation, which, when the threshold is exceeded, prompt an alert.

Step 2030: Designated administrator receives email and text service messages reporting deviation and suggesting action.

Figure 4A:
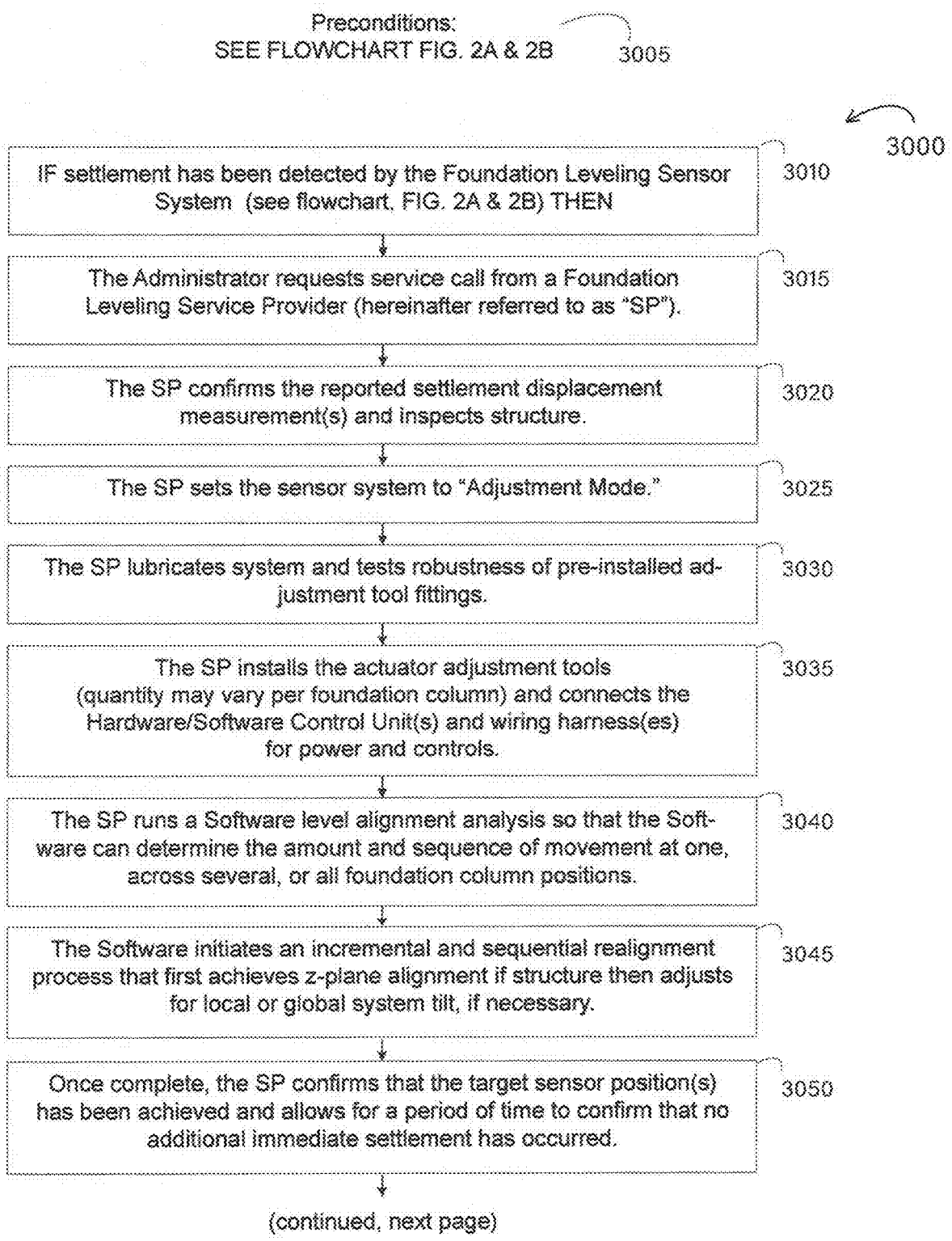
FIG. 4A is a flowchart of an embodiment of a method of a foundation leveling system with a removable actuator.
Figure 4B:
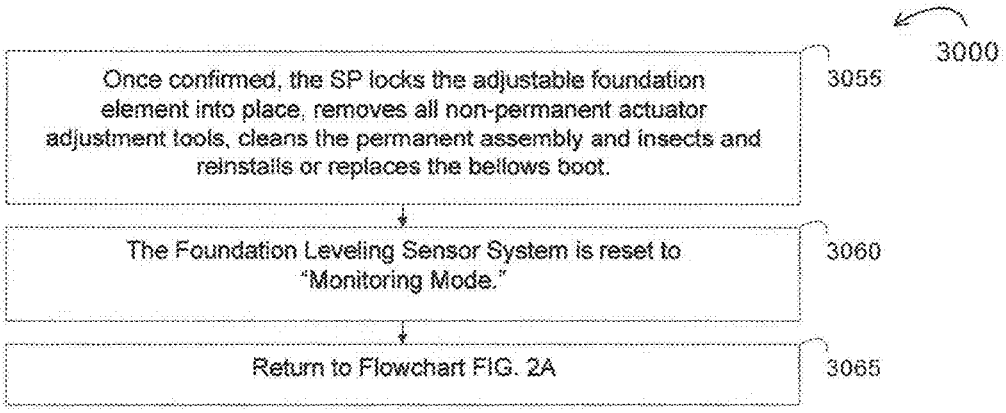
FIG. 4B is a continuation of FIG. 4A.

FIG. 4A and FIG. 4B contain a flowchart of an embodiment of a method of a foundation leveling system with a removable actuator.

Method 3000: FLOWCHART Correction Process with Removable Actuators

Preconditions 3005: See FLOWCHART 1000

Step 3010: IF settlement has been detected by the foundation leveling sensor system (see flowchart, 1000) THEN Step 3015: The administrator requests service call from a foundation leveling service provider (hereinafter referred to as "SP").

Step 3020: The SP confirms the reported settlement displacement measurement(s) and inspects structure.

Step 3025: The SP sets the sensor system to "adjustment mode."

Step 3030: The SP lubricates system and tests robustness of pre-installed adjustment tool fittings.

Step 3035: The SP installs the actuator adjustment tools (quantity may vary per foundation column) and connects the hardware/software control unit(s) and wiring harness(es) for power and controls.

Step 3040: The SP runs a software level alignment analysis so that the software can determine the amount and sequence of movement at one, across several, or all foundation column positions.

The software level alignment analysis takes the two data packages from system memory: the "contemporary" data set for each column position obtained from livestreamed sensor stack output, and the "as-built" data set stored as baseline data at time of initial build, and through a comparison of these data sets across the entire data system (gridded points) runs an algorithm (e.g., as described above following step 2025) to determine which actuator-able (whether temporary or permanent) column positions in the total build to activate to execute a controlled and choreographed adjustment to restore the contemporary state of the build to a state that closely approximates or is identical to the "as-built" data from the build.

Step 3045: The software initiates an incremental and sequential realignment process that, in an embodiment, first achieves z-plane alignment of structure then adjusts for local or global system tilt, if necessary. In an embodiment, each column height may be adjusted, e.g., returned to an original height, without regard to its position in a sequence of column height adjustments.

IF building system tilt is a feature of the settlement pattern, in an embodiment, the system will prioritize the resetting of the z-plane (floor plane) to achieve an even plane (even if tilted) to de-stress the structural diaphragm of the build, and THEN correct for tilt as a subsequent operation to achieve an outcome that is both planar and as level as possible.

Step 3050: Once complete, the SP confirms that the target sensor position(s) has been achieved and allows for a period of time to confirm that no additional immediate settlement has occurred.

Step 3055: Once confirmed, the SP locks the adjustable foundation element into place, removes all non-permanent actuator adjustment tools, cleans the permanent assembly and inspects and reinstalls or replaces the bellows boot.

Step 3060: The Foundation Leveling Sensor System is reset to "Monitoring Mode."

Step 3065: Return to Flowchart 1000

Figure 6A:
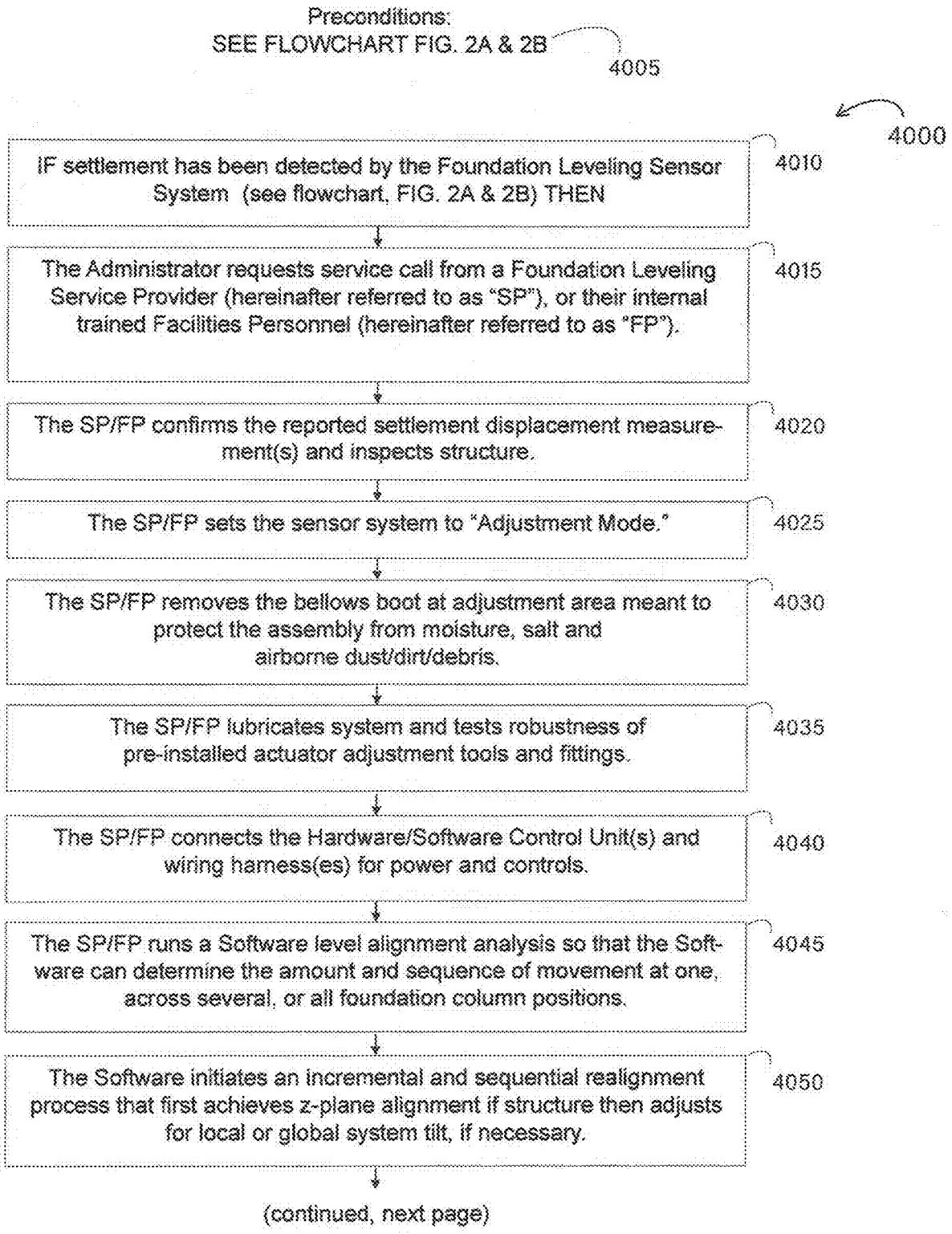
FIG. 6A is a flowchart illustrating an embodiment of a method of a foundation leveling system with a permanent actuator.
Figure 6B:
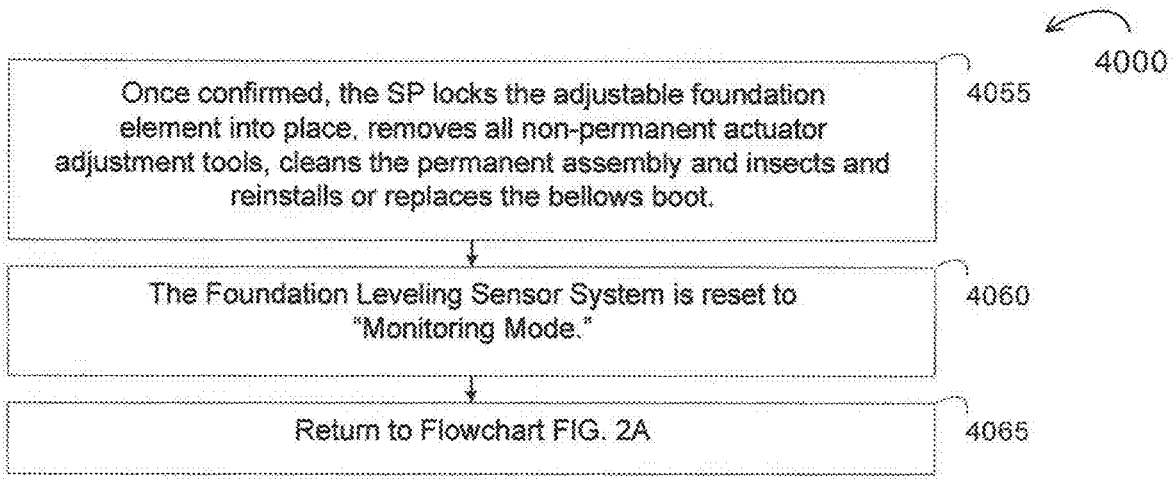
FIG. 6B is a continuation of FIG. 6A.

FIG. 6A and FIG. 6B contain a flowchart illustrating an embodiment of a method of a foundation leveling system with a permanent actuator;

Method 4000: FLOWCHART Correction Process with Permanent Actuators.

Preconditions 4005: SEE FLOWCHART 1000

Step 4010: IF settlement has been detected by the foundation leveling sensor system (see flowchart, 1000) THEN Step 4015: The administrator requests service call from a foundation leveling service provider (hereinafter referred to as "SP"), or their internal trained Facilities Personnel (hereinafter referred to as "FP").

Step 4020: The SP/FP confirms the reported settlement displacement measurement(s) and inspects structure.

Step 4025: The SP/FP sets the sensor system to "adjustment mode"

By setting the sensor system to "adjustment mode," the livestream data may be published out at a time-interval of greater frequency so as to provide nearly real-time tracking of positions useful to an active adjustment process. This differs from "monitoring mode" in which the sensors will publish out data at intervals of a lesser frequency in order to save power and preserve the longevity of system components).

Step 4030: The SP/FP removes the bellows boot at adjustment area meant to protect the assembly from moisture, salt and airborne dust/dirt/debris.

Step 4035: The SP/FP lubricates system and tests robustness of pre-installed actuator adjustment tools and fittings.

Step 4040: The SP/FP connects the Hardware/Software Control Unit(s) and wiring harness(es) for power and controls.

Step 4045: The SP/FP runs a software level alignment analysis so that the software can determine the amount and sequence of movement at one, across several, or all foundation column positions.

The software level alignment analysis takes the two data packages from system memory: the "contemporary" data set for each column position obtained from livestreamed sensor stack output, and the "as-built" data set stored as baseline data at time of initial build, and through a comparison of these data sets across the entire data system (gridded points) runs an algorithm (e.g., as described above following step 2025) to determine which actuator-able (whether temporary or permanent) column positions in the total build will need to be activated to execute a controlled and choreographed adjustment to restore the contemporary state of the build to a state that closely approximates or is identical to the "as-built" data from the build.

Step 4050: The software initiates an incremental and sequential realignment process that, in an embodiment, first achieves z-plane alignment of structure then adjusts for local or global system tilt, if necessary. In an embodiment, each column height may be adjusted, e.g., returned to an original height, without regard to its position in a sequence of column height adjustments.

Step 4055: Once confirmed, the SP locks the adjustable foundation element into place, removes all non-permanent actuator adjustment tools, cleans the permanent assembly and inspects and reinstalls or replaces the bellows boot.

Step 4060: The Foundation Leveling Sensor System is reset to "Monitoring Mode."

Step 4065: Return to Flowchart 1000.

Figure 8A:
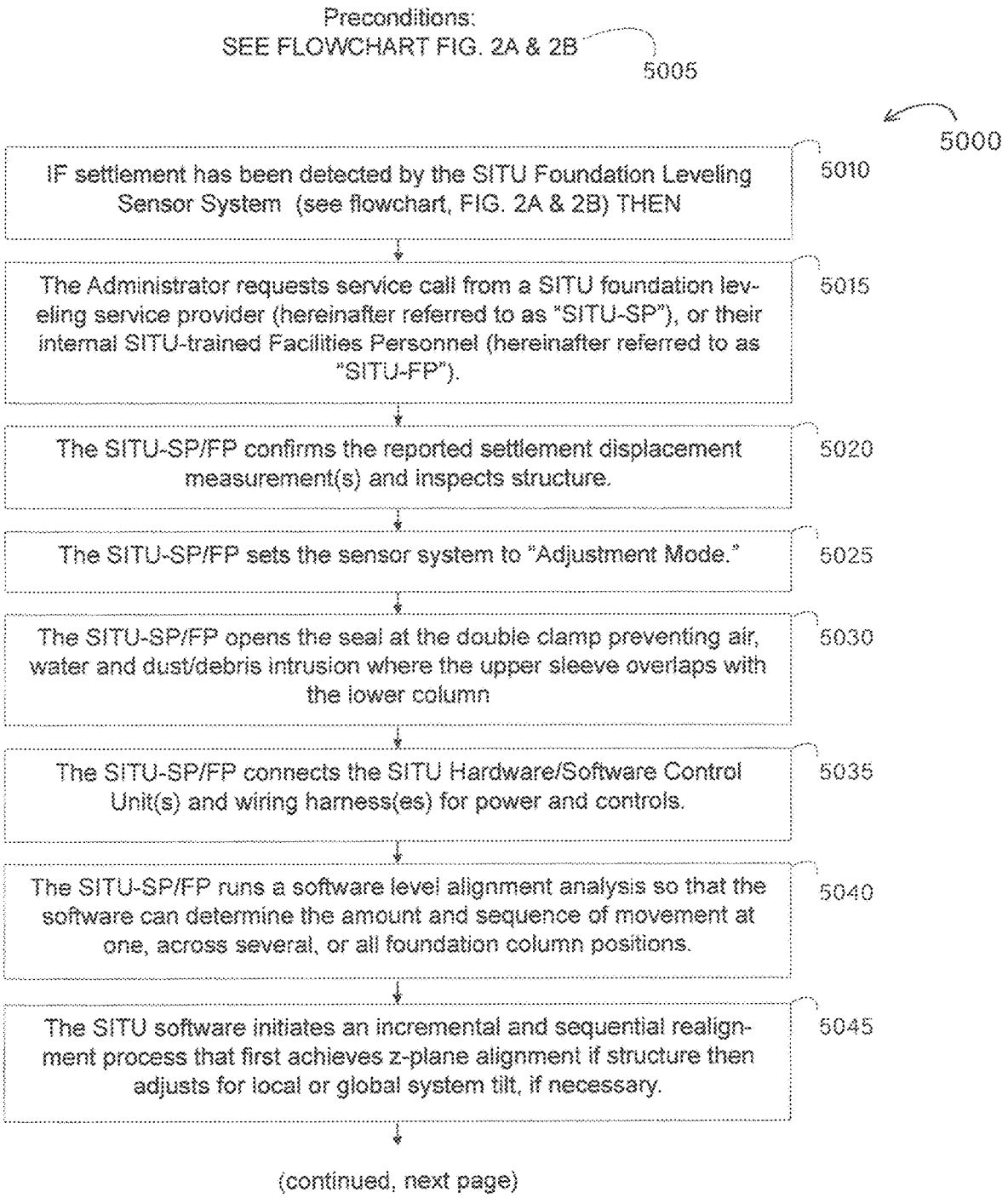
FIG. 8A is a flowchart illustrating an embodiment of a method of a foundation leveling system with a permanent geared actuator.
Figure 8B:
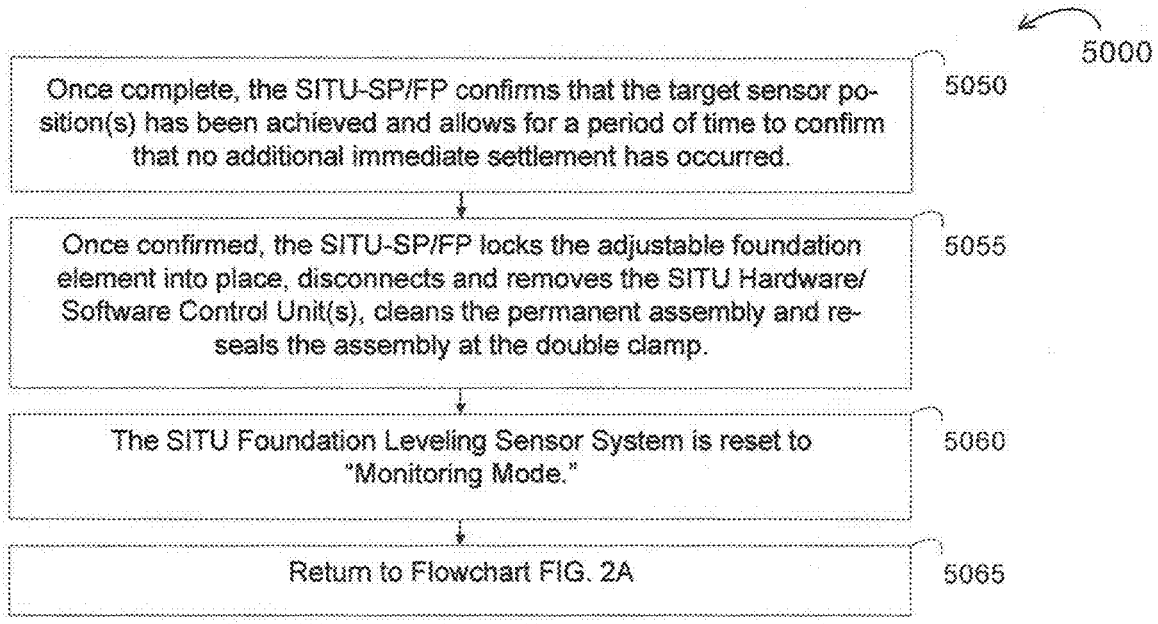
FIG. 8B is a continuation of FIG. 8A.

FIG. 8A and FIG. 8B contain a flowchart illustrating an embodiment of a method of a foundation leveling system with a permanent geared actuator.

Method 5000: FLOWCHART Correction Process with Permanent Geared (Heavy Duty Version)

Preconditions 5005: see FLOWCHART 1000

Step 5010: IF settlement has been detected by the foundation leveling sensor system (see flowchart, FIGS. 2A and 2B) THEN Step 5015: The administrator requests service call from a foundation leveling service provider (hereinafter referred to as "SP"), or their internal trained Facilities Personnel (hereinafter referred to as "FP").

Step 5020: The SP/FP confirms the reported settlement displacement measurement(s) and inspects structure.

Step 5025: The SP/FP sets the sensor system to "adjustment mode."

Step 5030: The SP/FP opens the seal at the double clamp preventing air, water and dust/debris intrusion where the upper sleeve overlaps with the lower column.

Step 5035: The SP/FP connects the hardware/software control unit(s) and wiring harness(es) for power and controls.

Step 5040: The SP/FP runs a software level alignment analysis so that the software can determine the amount and sequence of movement at one, across several, or all foundation column positions.

The software level alignment analysis takes the two data packages from system memory: the "contemporary" data set for each column position obtained from livestreamed sensor stack output, and the "as-built" data set stored as baseline data at time of initial build, and through a comparison of these data sets across the entire data system (gridded points) runs an algorithm to determine which actuator-able (whether temporary or permanent) column positions in the total build will need to be activated to execute a controlled and choreographed adjustment to restore the contemporary state of the build to a state that closely approximates or is identical to the "as-built" data from the build.

Step 5045: The software initiates an incremental and sequential realignment process that, in an embodiment, first achieves z-plane alignment if structure then adjusts for local or global system tilt, if necessary. In an embodiment, each column height may be adjusted, e.g., returned to an original height, without regard to its position in a sequence of column height adjustments.

If building system tilt is a feature of the settlement pattern, in an embodiment, the system will prioritize the resetting of the z-plane (floor plane) to achieve an even plane (even if tilted) to de-stress the structural diaphragm of the build, and then correct for tilt as a subsequent operation to achieve an outcome that is both planar and as level as possible.

Step 5050: Once complete, the SP/FP confirms that the target sensor position(s) has been achieved and allows for a period of time to confirm that no additional immediate settlement has occurred.

Step 5055: Once confirmed, the SP/FP locks the adjustable foundation element into place, disconnects and removes the Hardware/Software Control Unit(s), cleans the permanent assembly and reseals the assembly at the double clamp.

Step 5060: The foundation leveling sensor system is reset to "monitoring mode."

Step 5065: Return to Flowchart 1000

Software Description

In embodiments, system 115 is provided with software that perform or initiate the performance of steps of the methods discussed above. This software may provide one or more the following features and be developed using one or more of the following methods.

Utilizing IoT (Internet of Things) sensors for real-time monitoring of foundation differential settlement will involve a network of interconnected sensors (300) that gather and send data about a building's foundation (120, 130 and 200) and floor framing (140) to a centralized monitoring system (110 and 115). This system examines the data in real-time, issuing alerts or notifications if it identifies any signs of differential settlement. This IoT-based monitoring system aids in preventing structural damage caused by differential settlement by facilitating timely interventions.

The following is an overview of how IoT sensors may be employed for this purpose:

- Sensor installation: Place various types of sensors (300), such as inclinometers, accelerometers, strain gauges, and settlement plates, at key locations in the foundation and other vital areas of the building. These sensors include IoT capabilities (350), allowing them to connect to the internet and wirelessly transmit data.
- Data gathering and transmission: IoT sensors constantly collect data on foundation movement, tilt, strain, and settlement. This data is wirelessly sent to a central monitoring system (110, 115) using Wi-Fi, cellular networks, or other communication protocols.
- Central monitoring system: The central monitoring system obtains data from all the installed IoT sensors and processes it in real-time. This system can be a cloud-based platform (115) and/or an on-site server (110), depending on the building owner or manager's specific needs and preferences.
- Data analysis and alert generation: The central monitoring system 115 examines the sensor data to find patterns and trends that could indicate differential settlement. If the system identifies any signs of uneven settling, it generates alerts or notifications, which can be sent to designated personnel via email, text messages, or mobile app notifications. Patterns and trends is important in the context of building over permafrost where refreezing after thawing may create a heave which can essentially result in the building sinking during thaw and lifting up again during refreezing. In this way, simple settlement, if it is even and predictable, is not necessarily a triggering event for adjustment. By patterns and trend then we are talking about data stored in the system, e.g., data received from the sensor stack over time, that reflects the typical range of motion of the building throughout the course of an entire year. The system may compare this stored data to the current data and, based on the comparison, identify a variation that is abnormal and needs to be addressed through an adjustment intervention.
- Preventive actions and maintenance: When an alert is received, the responsible individuals can take necessary preventive measures to address the issue by adjusting the foundation through the use of the SITU foundation actuator toolkit (201, 202 and/or 203). This real-time monitoring and alerting system can help avoid significant structural damage and lower maintenance costs.
- Data storage and historical analysis: The IoT-based monitoring system can store the gathered data for future reference and historical analysis. This enables engineers and building managers to examine long-term trends, pinpoint potential weak spots in the foundation, and schedule maintenance activities accordingly.

The system can be used to prevent structural damage and ensure timely interventions. By monitoring the foundation's differential settlement in real-time, the system can identify any signs of problems early on and take corrective action before the damage becomes too severe. This can save the owner of the structure a lot of money in repairs and maintenance costs.

The system consists of the following components:

- Sensors (300): These are the devices that measure the foundation's differential settlement. They can be either wired or wireless.
- Data Acquisition and Processing Unit (DAPU) (110, 115): This unit(s) collects data from the sensors and processes it to identify any signs of differential settlement.
- Actuator Control Unit (215): This unit receives data from the DAPU and commands elements 201, 202, or 203 to move in the appropriate direction to re-level the structure.
- Piers (130 and/or 230): made of steel or concrete and are installed below the foundation.
- Linear Actuators (214 and/or 220 and/or 227): These are the devices that move elements 201, 202, 203. They are typically hydraulic or electric.

The software architecture of the system is as follows:

The sensors collect data and send it to the DAPU.

The DAPU processes the data and identifies any signs of differential settlement.

The control unit receives data from the DAPU and commands elements 201, 202, or 203 to move in the appropriate direction to re-level the structure.

The elements 201, 202, or 203 move the structure to a level z plane.

The system may be closed loop with the control unit receiving feedback from the sensors and using that feedback to adjust the movement of elements 201, 202, or 203. This ensures that the structure is always kept level.

The system is also very versatile. It can be used to monitor the foundation of any type of structure, including buildings, bridges, and other infrastructure. It is also very easy to install and maintain.

The software models that may be used in conjunction to create the system described above are as follows:

Sensor data acquisition and processing model: This model is responsible for collecting data from the sensors and processing it to identify any signs of differential settlement. The model handles a large volume of data and is able to identify patterns in the data that indicate differential settlement. For example, a pattern may be identified by comparing contemporary data to both the as-built data and any trend data that describes expected and acceptable building level change through a freeze-thaw process (these data points may be mathematically defined by engineers and entered into the software as limits to acceptable range of deviation).

Control model: This model is responsible for receiving data from the sensor data acquisition and processing model and commanding the actuators of elements 201, 202, or 203 that control the leveling piers to move in the appropriate direction to re-level the structure. The model may make decisions quickly and accurately in order to keep the structure level.

Communication model: This model is responsible for communicating between the different components of the system. The model may send and receive data quickly and reliably.

User interface model: This model is responsible for providing the user with a way to interact with the system. The model is preferably easy to use and understand. The software models may be integrated together in order to create a working system.

The mathematical equations that may be used to solve for the system described above are as follows:

Sensor Data Acquisition and Processing Model

The sensor data acquisition and processing model may use the following mathematical equations:

Signal processing: The signal processing equations may be used to clean up the data and remove any noise. This may be done using a variety of techniques, such as:

Low-pass filtering: This technique removes high-frequency noise from the data.

Median filtering: This technique replaces each data point with the median of its neighbors.

Savitsky-Golay filtering: This technique fits a polynomial to the data and then uses the polynomial to smooth the data.

Statistical analysis: The statistical analysis equations may be used to identify patterns in the data that indicate differential settlement. This may be done using a variety of techniques, such as:

Histograms: This technique creates a histogram of the data to show the distribution of the data.

Boxplots: This technique creates a boxplot of the data to show the median, quartiles, and outliers of the data.

Outlier detection: This technique identifies any data points that are significantly different from the rest of the data.

Machine learning: The machine learning equations may be used to train a model to automatically identify differential settlement from the data. This may be done using a variety of techniques, such as:

Support vector machines: This technique creates a model that can classify data points as either having differential settlement or not having differential settlement.

Neural networks: This technique creates a model that can learn to identify differential settlement from the data.

Control Model:

The control model may use the following mathematical equations:

Linear algebra: The linear algebra equations may be used to solve for the optimal movement of elements 201, 202, or 203. This may be done using a variety of techniques, such as:

Least squares: This technique finds the movement of elements 201, 202, or 203 that minimizes the error between the desired position of the structure and the actual position of the structure.

Quadratic programming: This technique finds the movement of elements 201, 202, or 203 that minimizes the cost of the movement while satisfying the constraints of the system.

Numerical optimization: The numerical optimization equations may be used to find the best possible movement of elements 201, 202, or 203 given the constraints of the system. This may be done using a variety of techniques, such as: ○ Gradient descent: This technique iteratively moves the elements 201, 202, or 203 in the direction that decreases the cost of the movement. ○ Simulated annealing: This technique allows the elements 201, 202, or 203 to move in a random direction in order to escape local minima.

Control theory: The control theory equations may be used to design a controller that can keep the structure level in the presence of disturbances. This may be done using a variety of techniques, such as:

PID control: This technique uses a proportional, integral, and derivative controller to keep the structure level.

LQR control: This technique uses a linear quadratic regulator to keep the structure level.

Code may be written to achieve taking into account the type of structure, structural weight, soil conditions including moisture and temperature, and other factors:

The type of structure: The code may include an indication of the type of structure being monitored and corollary data such as expected live and dead loads (including seasonal change such as snow load). Such loads may be calculated mathematically by qualified engineers and entered into the software as lists to acceptable range of deviation. This allows the code to make adjustments to the monitoring parameters based on the specific needs of the structure. For example, a code that is monitoring a bridge would need to take into account transitory live loads and the wind load (which may include a mathematically defined range of deviation calculated by qualified engineers) that it is subject to.

The structural weight: The code may calculate the structural weight. This allows the code to make adjustments to the monitoring parameters based on the weight of the structure. For example, a code that is monitoring a building would need to take into account the live load weight of the building's contents, i.e., a mathematically defined range of allowable weights calculated by qualified engineers usually calculated on a per square foot/meter basis. This information is entered into software from engineering data produced by qualified engineers. The control software uses this weight (per square foot/meter) data to determine a threshold for alert in the event of an outsized deviation for transitory loads as expressed in accelerometer sensor data.

Soil/Substrate conditions: The code may identify the soil/substrate (permafrost, for example) conditions, e.g., mathematically defined characteristics of soil substrate bearing and hold (lift) capacity in the given geography as defined by soils/substrate test results that are obtained and entered into the software. This allows the code to make adjustments to the monitoring parameters based on the specific needs of the soil/substrate. For example, a code that is monitoring a structure in a sandy soil would need to take into account the fact that sandy soils are more prone to settlement than clay soils.

Moisture and temperature: The code may measure the moisture and temperature of the soil/substrate, e.g., rainfall and temperature in the given geography, which may be obtained and entered into the software. This allows the code to make adjustments to the monitoring parameters based on the specific needs of the soil/substrate. For example, a code that is monitoring a structure in a wet soil/substrate would need to take into account the fact that wet soils/substrates are more prone to settlement than dry soils/substrates.

The code is preferably written in a way that is flexible and adaptable. This allows the code to be used to monitor a variety of structures in a variety of conditions. The code is preferably reliable and efficient. This ensures that the code is able to accurately monitor the structure and take corrective action when necessary.

The methodology and process steps behind the system described above are as follows for some embodiments:

Installation: The system is installed by first installing the appropriate connections for actuators to the point-load foundation leveling system. The sensors are then placed at key points in the foundation and/or floor framing system that correspond to those point-load foundation locations. The sensors are then connected to the DAPU, which is then connected to the control unit.

Calibration: The system is calibrated by first collecting data from the sensors. The data is then processed by the DAPU to identify any signs of differential settlement. The control unit is then used to adjust the movement of elements 201, 202, or 203 until the structure is level.

Operation: The system operates in a closed loop. The sensors collect data and send it to the DAPU. The DAPU processes the data and identifies any signs of differential settlement. The control unit then commands the elements 201, 202, or 203 to move in the appropriate direction to re-level the structure.

Maintenance: The system should be regularly inspected and maintained to ensure that it is operating properly. This includes inspecting the sensors, the DAPU, the control unit, and the elements 201, 202, or 203.

Figure 10:
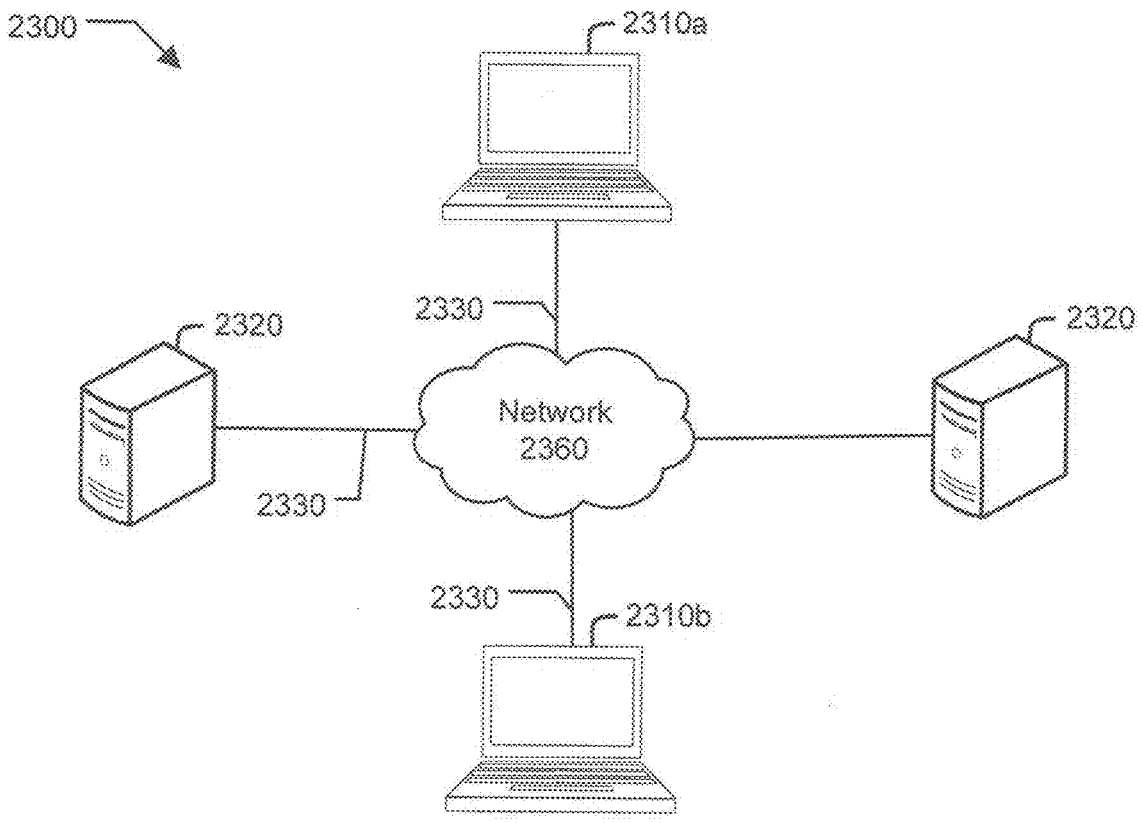
FIG. 10 is an exemplary block diagram depicting an embodiment of a system for implementing embodiments of methods of the disclosure.

FIG. 10 is an exemplary block diagram depicting an embodiment of system 115 for implement embodiments of methods of the disclosure, e.g., as described with reference to the previous figures, and particularly elements 110, 115, 215, and 300.

In FIG. 10, computer network 2300 includes a number of computing devices 2310*a*-2310*b* (each of which may implement element 115), and one or more server systems 2320 coupled to a communication network 2360 via a plurality of communication links 2330. Communication network 2360 provides a mechanism for allowing the various components of distributed network 2300 to communicate and exchange information with each other. Thus, FIG. 10 describes systems for implementing elements 110, 115, 215, and 300, and communications between them.

Communication network 2360 itself is comprised of one or more interconnected computer systems and communication links. Communication links 2330 may include hardwire links, optical links, satellite or other wireless communications links, wave propagation links, or any other mechanisms for communication of information. Various communication protocols may be used to facilitate communication between the various systems shown in FIG. 10. These communication protocols may include TCP/IP, UDP, HTTP protocols, wireless application protocol (WAP), BLUETOOTH, Zigbee, 802.11, 802.15, 6LoWPAN, LiFi, Google Weave, NFC, GSM, CDMA, other cellular data communication protocols, wireless telephony protocols, Internet telephony, IP telephony, digital voice, voice over broadband (VoBB), broadband telephony, Voice over IP (VOIP), vendor-specific protocols, customized protocols, and others. While in one embodiment, communication network 2360 is the Internet, in other embodiments, communication network 2360 may be any suitable communication network including a local area network (LAN), a wide area network (WAN), a wireless network, a cellular network, a personal area network, an intranet, a private network, a near field communications (NFC) network, a public network, a switched network, a peer-to-peer network, and combinations of these, and the like.

In an embodiment, the server 2320 is not located near a user of a computing device, and is communicated with over a network. In a different embodiment, the server 2320 is a device that a user can carry upon his person, or can keep nearby. In an embodiment, the server 2320 has a large battery to power long distance communications networks such as a cell network (LTE, 5G), or Wi-Fi. The server 2320 communicates with the other components of the system via wired links or via low powered short-range wireless communications such as Bluetooth®. In an embodiment, one of the other components of the system plays the role of the server, e.g., the PC 2310*b*.

Distributed computer network 2300 in FIG. 10 is merely illustrative of an embodiment incorporating the embodiments and does not limit the scope of the invention as recited in the claims. One of ordinary skill in the art would recognize other variations, modifications, and alternatives. For example, more than one server system 2320 may be connected to communication network 2360. As another example, a number of computing devices 2310*a*-2310*b* may be coupled to communication network 2360 via an access provider (not shown) or via some other server system.

Computing devices 2310*a*-2310*b* typically request information from a server system that provides the information. Server systems by definition typically have more computing and storage capacity than these computing devices, which are often such things as portable devices, mobile communications devices, or other computing devices that play the role of a client in a client-server operation. However, a particular computing device may act as both a client and a server depending on whether the computing device is requesting or providing information. Aspects of the embodiments may be embodied using a client-server environment or a cloud-cloud computing environment.

Server 2320 is responsible for receiving information requests from computing devices 2310*a*-2310*b*, for performing processing required to satisfy the requests, and for forwarding the results corresponding to the requests back to the requesting computing device. The processing required to satisfy the request may be performed by server system 2320 or may alternatively be delegated to other servers connected to communication network 2360 or to other communications networks. A server 2320 may be located near the computing devices 2310 or may be remote from the computing devices 2310. A server 2320 may be a hub controlling a local enclave of things in an internet of things scenario.

Computing devices 2310*a*-2310*b* enable users to access and query information or applications stored by server system 2320. Some example computing devices include portable electronic devices (e.g., mobile communications devices) such as the Apple iPhone®, the Apple iPad®, the Palm Pre™, or any computing device running the Apple iOS™, Android™ OS, Google Chrome OS, Symbian OS®, Windows 10, Windows Mobile® OS, Palm OS® or Palm Web OS™, or any of various operating systems used for Internet of Things (IoT) devices or automotive or other vehicles or Real Time Operating Systems (RTOS), such as the RIOT OS, Windows 10 for IoT, WindRiver VxWorks, Google Brillo, ARM Mbed OS, Embedded Apple iOS and OS X, the Nucleus RTOS, Green Hills Integrity, or Contiki, or any of various Programmable Logic Controller (PLC) or Programmable Automation Controller (PAC) operating systems such as Microware OS-9, VxWorks, QNX Neutrino, FreeRTOS, Micrium μC/OS-II, Micrium C/OS-III, Windows CE, TI-RTOS, RTEMS. Other operating systems may be used. In a specific embodiment, a "web browser" application executing on a computing device enables users to select, access, retrieve, or query information and/or applications stored by server system 2320. Examples of web browsers include the Android browser provided by Google, the Safari® browser provided by Apple, the Opera Web browser provided by Opera Software, the BlackBerry® browser provided by Research In Motion, the Internet Explorer® and Internet Explorer Mobile browsers provided by Microsoft Corporation, the Firefox® and Firefox for Mobile browsers provided by Mozilla®, and others.

Figure 11:
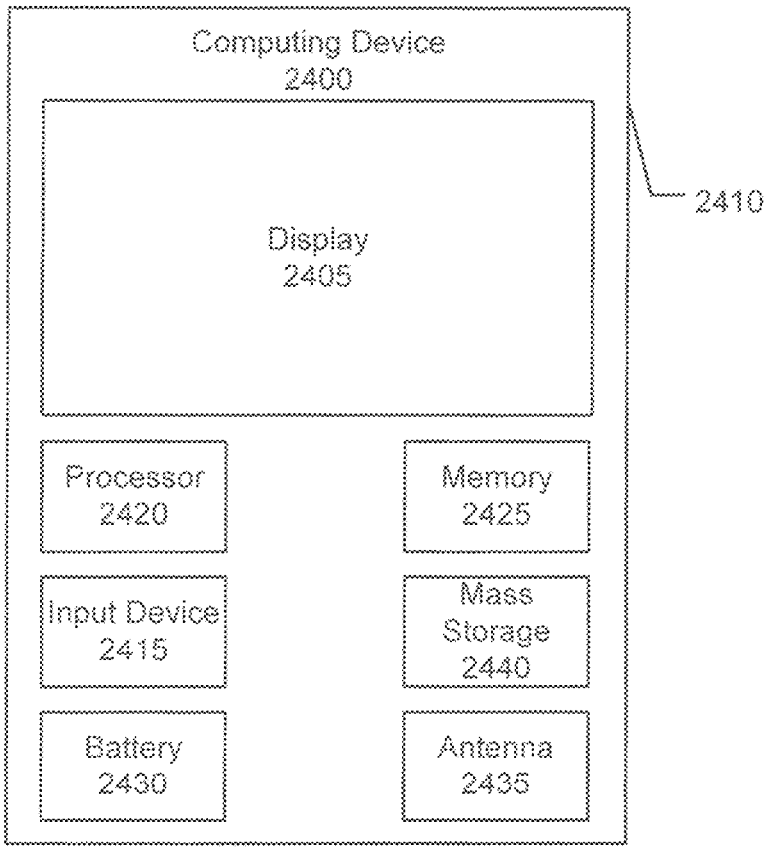
FIG. 11 is an exemplary block diagram depicting a computing device.

FIG. 11 is an exemplary block diagram depicting a computing device 2400 of an embodiment. Computing device 2400 may be any of the computing devices 2310 from FIG. 10. Computing device 2400 may include a display, screen, or monitor 2405, housing 2410, and input device 2415. Housing 2410 houses familiar computer components, some of which are not shown, such as a processor 2420, memory 2425, battery 2430, speaker, transceiver, antenna 2435, microphone, ports, jacks, connectors, camera, input/output (I/O) controller, display adapter, network interface, mass storage devices 2440, various sensors, and the like.

Input device 2415 may also include a touchscreen (e.g., resistive, surface acoustic wave, capacitive sensing, infrared, optical imaging, dispersive signal, or acoustic pulse recognition), keyboard (e.g., electronic keyboard or physical keyboard), buttons, switches, stylus, or combinations of these.

Mass storage devices 2440 may include flash and other nonvolatile solid-state storage or solid-state drive (SSD), such as a flash drive, flash memory, or USB flash drive. Other examples of mass storage include mass disk drives, floppy disks, magnetic disks, optical disks, magneto-optical disks, fixed disks, hard disks, SD cards, CD-ROMs, recordable CDs, DVDs, recordable DVDs (e.g., DVD-R, DVD+R, DVD-RW, DVD+RW, HD-DVD, or Blu-ray Disc), battery-backed-up volatile memory, tape storage, reader, and other similar media, and combinations of these.

Embodiments may also be used with computer systems having different configurations, e.g., with additional or fewer subsystems, and may include systems provided by Arduino, or Raspberry Pi. For example, a computer system could include more than one processor (i.e., a multiprocessor system, which may permit parallel processing of information) or a system may include a cache memory. The computer system shown in FIG. 11 is but an example of a computer system suitable for use with the embodiments. Other configurations of subsystems suitable for use with the embodiments will be readily apparent to one of ordinary skill in the art. For example, in a specific implementation, the computing device is a mobile communications device such as a smartphone or tablet computer. Some specific examples of smartphones include the Droid Incredible and Google *Nexus* One, provided by HTC Corporation, the iPhone or iPad, both provided by Apple, and many others. The computing device may be a laptop or a netbook. In another specific implementation, the computing device is a non-portable computing device such as a desktop computer or workstation.

A computer-implemented or computer-executable version of the program instructions useful to practice the embodiments may be embodied using, stored on, or associated with computer-readable medium. A computer-readable medium may include any medium that participates in providing instructions to one or more processors for execution, such as memory 2425 or mass storage 2440. Such a medium may take many forms including, but not limited to, nonvolatile, volatile, transmission, non-printed, and printed media. Nonvolatile media includes, for example, flash memory, or optical or magnetic disks. Volatile media includes static or dynamic memory, such as cache memory or RAM. Transmission media includes coaxial cables, copper wire, fiber optic lines, and wires arranged in a bus. Transmission media can also take the form of electromagnetic, radio frequency, acoustic, or light waves, such as those generated during radio wave and infrared data communications.

For example, a binary, machine-executable version, of the software useful to practice the embodiments may be stored or reside in RAM or cache memory, or on mass storage device 2440. The source code of this software may also be stored or reside on mass storage device 2440 (e.g., flash drive, hard disk, magnetic disk, tape, or CD-ROM). As a further example, code useful for practicing the embodiments may be transmitted via wires, radio waves, or through a network such as the Internet. In another specific embodiment, a computer program product including a variety of software program code to implement features of the embodiment is provided.

Computer software products may be written in any of various suitable programming languages, such as C, C++, C #, Pascal, Fortran, Perl, Matlab (from MathWorks, www.mathworks.com), SAS, SPSS, JavaScript, CoffeeScript, Objective-C, Swift, Objective-J, Ruby, Rust, Python, Erlang, Lisp, Scala, Clojure, and Java. The computer software product may be an independent application with data input and data display modules. Alternatively, the computer software products may be classes that may be instantiated as distributed objects. The computer software products may also be component software such as Java Beans (from Oracle) or Enterprise Java Beans (EJB from Oracle).

An operating system for the system may be the Android operating system, iPhone OS (i.e., iOS), Symbian, BlackBerry OS, Palm web OS, Bada, MeeGo, Maemo, Limo, or Brew OS. Other examples of operating systems include one of the Microsoft Windows family of operating systems (e.g., Windows 95, 98, Me, Windows NT, Windows 2000, Windows XP, Windows XP x64 Edition, Windows Vista, Windows 10 or other Windows versions, Windows CE, Windows Mobile, Windows Phone, Windows 10 Mobile), Linux, HP-UX, UNIX, Sun OS, Solaris, Mac OS X, Alpha OS, AIX, IRIX32, or IRIX64, or any of various operating systems used for Internet of Things (IoT) devices or automotive or other vehicles or Real Time Operating Systems (RTOS), such as the RIOT OS, Windows 10 for IoT, WindRiver VxWorks, Google Brillo, ARM Mbed OS, Embedded Apple IOS and OS X, the Nucleus RTOS, Green Hills Integrity, or Contiki, or any of various Programmable Logic Controller (PLC) or Programmable Automation Controller (PAC) operating systems such as Microware OS-9, Vx Works, QNX Neutrino, FreeRTOS, Micrium μC/OS-II, Micrium μC/OS-III, Windows CE, TI-RTOS, RTEMS. Other operating systems may be used.

Furthermore, the computer may be connected to a network and may interface to other computers using this network. The network may be an intranet, internet, or the Internet, among others. The network may be a wired network (e.g., using copper, and connections such as RS232 connectors), telephone network, packet network, an optical network (e.g., using optical fiber), or a wireless network, or any combination of these. For example, data and other information may be passed between the computer and components (or steps) of a system useful in practicing the embodiments using a wireless network employing a protocol such as Wi-Fi (IEEE standards 802.11, 802.11a, 802.11b, 802.11e, 802.11g, 802.11i, and 802.11n, just to name a few examples), or other protocols, such as BLUETOOTH or NFC or 802.15 or cellular, or communication protocols may include TCP/IP, UDP, HTTP protocols, wireless application protocol (WAP), BLUETOOTH, Zigbee, 802.11, 802.15, 6LoWPAN, LiFi, Google Weave, NFC, GSM, CDMA, other cellular data communication protocols, wireless telephony protocols or the like. For example, signals from a computer may be transferred, at least in part, wirelessly to components or other computers.

ENUMERATED EMBODIMENTS

1. A computer-implemented method for leveling a foundation, comprising:
   obtaining initial column top locations relative to a plane;
   monitoring positions of the column top locations;
   comparing the monitored positions of the column top locations;
   detecting, based on the comparison, a settlement of at least one column top location; and
   adjusting the at least one column top location to correct the settlement.

2. The computer-implemented method of embodiment 1, wherein comparing the monitored positions of the column top locations includes:
   comparing the monitored positions of the column top locations to the initial column top locations.

3. The computer-implemented method of embodiment 1, wherein comparing the monitored positions of the column top locations includes:
   comparing the monitored position of at least one first column top location to the monitored positions of the remainder of the column top locations.

4. The computer-implemented method of embodiment 1, further comprising: communicating an alert to an administrator when the detected settlement exceeds a threshold;
   determining, by the administrator, to have the at least one column top location adjusted when the detected settlement exceeds an acceptable settlement.

5. The computer-implemented method of embodiment 1, further comprising:
   after the adjusting at least one of the column top locations:
   capturing second column top locations relative to the plane
   continuing monitoring the positions of the column top locations; and
   comparing the continued monitored positions of the column top locations to both the initial column top locations and to the second column top locations.

6. The computer-implemented method of embodiment 1, wherein adjusting at least one of the column top locations to correct the settlement includes:
   analyzing the settlement to determine which of the column top locations to adjust;
   determining, for each of the column top locations to adjust, an amount of adjustment; and
   determining a sequence of adjusting the column top locations determined to be adjusted.

7. The computer-implemented method of embodiment 6, wherein adjusting at least one of the column top locations to correct the settlement includes:
   adjusting the column top locations determined to be adjusted to achieve a planar alignment of the column top locations.

8. The computer-implemented method of embodiment 7, wherein adjusting the column top locations to correct the settlement includes, after achieving the planar alignment of the column top locations: adjusting the column top locations to correct a tilt of the planar alignment.

9. A system for leveling a foundation, the system including a plurality of sensors, at least one actuator, and a computing device including a processor with memory including instructions, which when executed, cause the system to perform actions, comprising:
   capturing, by the computing device, initial column top locations relative to the x-plane from data communicated by the plurality of sensors;
   monitoring, by the computing device, positions of the column top locations;
   comparing, by the computing device, the monitored positions of the column top locations;
   detecting, by the computing device, based on the comparison, a settlement of at least one column top location; and
   causing, by the computing device, the at least one actuator to adjust the at least one column top location to correct the settlement.

10. The system of embodiment 9, wherein comparing, by the computing device, the monitored positions of the column top locations includes:
   comparing, by the computing device, the monitored positions of the column top locations to the initial column top locations.

11. The system of embodiment 9, wherein comparing, by the computing device, the monitored positions of the column top locations includes:
   comparing, by the computing device, the monitored position of a first column top location to the monitored positions of the remainder of the column top locations.

12. The system of embodiment 9, the actions further comprising:

communicating, by the computing device, an alert to an administrator when the detected settlement exceeds a threshold.

13. The system method of embodiment 9, the actions further comprising:

after the adjusting:

capturing, by the computing device, second column top locations relative to the plane monitoring, by the computing device, the positions of the column top locations; and comparing, by the computing device, the monitored positions of the column top locations to both the initial column top locations and to the second column top locations.

14. The system of embodiment 9, wherein adjusting at least one column top location to correct the settlement includes:

analyzing the settlement to determine which of the column top locations to adjust; and determining, for each of the column top locations to adjust, an amount of adjustment necessary; and determining a sequence of adjusting the column top locations determined to be adjusted.

15. The system of embodiment 14, wherein adjusting the column top locations to correct the settlement includes:

causing, by the computing device, the at least one actuator to adjust the column top locations determined to be adjusted to achieve a planar alignment of the column top locations.

16. The system of embodiment 15, wherein adjusting the column top locations to correct the settlement includes, after achieving the planar alignment of the column top locations: causing, by the computing device, the at least one actuator to adjust the column top locations to correct a tilt of the planar alignment.

17. A non-transitory computer-readable medium comprising instructions, which when executed by a computing device of a system for leveling a foundation, cause the system to perform actions, comprising:

capturing initial column top locations relative to the plane from data communicated by a plurality of sensors;

monitoring positions of the column top locations;

comparing the monitored positions of the column top locations;

detecting, based on the comparison, a settlement of at least one column top location; and causing the at least one actuator to adjust the at least one column top location to correct the settlement.

18. The non-transitory computer-readable medium of embodiment 17, wherein comparing the monitored positions of the column top locations includes:

comparing the monitored positions of the column top locations to the initial column top locations.

19. The non-transitory computer-readable medium of embodiment 17, wherein comparing the monitored positions of the column top locations includes:

comparing the monitored position of a first column top location to the monitored positions of the remainder of the column top locations.

20. The non-transitory computer-readable medium of embodiment 17, the actions further comprising:

Communicating an alert to an administrator when the detected settlement exceeds a threshold.

While the embodiments have been described with regards to particular embodiments, it is recognized that additional variations may be devised without departing from the inventive concept.

The terminology used herein is for the purpose of describing particular embodiments only and is not intended to be limiting of the claimed subject matter. As used herein, the term "and/or" includes any and all combinations of one or more of the associated listed items. As used herein, the singular forms "a," "an," and "the" are intended to include the plural forms as well as the singular forms, unless the context clearly indicates otherwise. It will further be understood that the terms "comprises" and/or "comprising," when used in this specification, specify the presence of states features, steps, operations, elements, and/or components, but do not preclude the present or addition of one or more other features, steps, operations, elements, components, and/or groups thereof.

Unless otherwise defined, all terms (including technical and scientific terms) used herein have the same meaning as commonly understood by one having ordinary skill in the art to which the embodiments belong. It will further be understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the embodiments, it will be understood that a number of elements, techniques, and steps are disclosed. Each of these has individual benefit and each can also be used in conjunction with one or more, or in some cases all, of the other disclosed elements, or techniques. The specification and claims should be read with the understanding that such combinations are entirely within the scope of the embodiments and the claimed subject matter.

In the description above and throughout, numerous specific details are set forth in order to provide a thorough understanding of an embodiment of this disclosure. It will be evident, however, to one of ordinary skill in the art, that an embodiment may be practiced without these specific details. In other instances, well-known structures and devices are shown in block diagram form to facilitate explanation. The description of the preferred embodiments is not intended to limit the scope of the claims appended hereto. Further, in the methods disclosed herein, various steps are disclosed illustrating some of the functions of an embodiment. These steps are merely examples and are not meant to be limiting in any way. Other steps and functions may be contemplated without departing from this disclosure or the scope of an embodiment.

What is claimed is:

1. A computer-implemented method for leveling a foundation, comprising:

obtaining initial column top locations relative to a plane;

monitoring positions of the column top locations;

comparing the monitored positions of the column top locations;

detecting, based on the comparison, a settlement of at least one column top location;

analyzing the settlement to determine which of the column top locations to adjust;

determining, for each of the column top locations to adjust, an amount of adjustment to achieve a planar alignment of the column top locations;

adjusting the column top locations to achieve the planar alignment of the column top locations; and after achieving the planar alignment of the column top locations, adjusting the column top locations to correct a tilt of the planar alignment.

2. The computer-implemented method of claim 1, wherein comparing the monitored positions of the column top locations includes:

comparing the monitored positions of the column top locations to the initial column top locations.

3. The computer-implemented method of claim 1, wherein comparing the monitored positions of the column top locations includes:

comparing the monitored position of at least one first column top location to the monitored positions of the remainder of the column top locations.

4. The computer-implemented method of claim 1, further comprising:

communicating an alert to an administrator when the detected settlement exceeds a threshold;

determining, by the administrator, to have the at least one column top location adjusted when the detected settlement exceeds an acceptable settlement.

5. The computer-implemented method of claim 1, further comprising:

after the adjusting at least one of the column top locations:

capturing second column top locations relative to the plane continuing monitoring the positions of the column top locations; and comparing the continued monitored positions of the column top locations to both the initial column top locations and to the second column top locations.

6. The computer-implemented method of claim 1, further comprising determining a sequence of adjusting the column top locations determined to be adjusted.

7. A system for leveling a foundation, the system including a plurality of sensors, at least one actuator, and a computing device including a processor with memory including instructions, which when executed, cause the system to perform actions, comprising:

capturing, by the computing device, initial column top locations relative to an x-plane from data communicated by the plurality of sensors;

monitoring, by the computing device, positions of the column top locations;

comparing, by the computing device, the monitored positions of the column top locations;

detecting, by the computing device, based on the comparison, a settlement of at least one column top location;

analyzing, by the computing device, the settlement to determine which of the column top locations to adjust;

determining, by the computing device, for each of the column top locations to adjust, an amount of adjustment to achieve a planar alignment of the column top locations;

causing, by the computing device, the at least one actuator to adjust the column top locations determined to achieve the planar alignment of the column top locations; and after achieving the planar alignment of the column top locations, causing, by the computing device, the at least one actuator to adjust the column top locations to correct a tilt of the planar alignment.

8. The system of claim 7, wherein comparing, by the computing device, the monitored positions of the column top locations includes:

comparing, by the computing device, the monitored positions of the column top locations to the initial column top locations.

9. The system of claim 7, wherein comparing, by the computing device, the monitored positions of the column top locations includes:

comparing, by the computing device, the monitored position of a first column top location to the monitored positions of the remainder of the column top locations.

10. The system of claim 7, the actions further comprising:

communicating, by the computing device, an alert to an administrator when the detected settlement exceeds a threshold.

11. The system of claim 7, the actions further comprising:

after the adjusting:

capturing, by the computing device, second column top locations relative to the plane;

monitoring, by the computing device, the positions of the column top locations; and comparing, by the computing device, the monitored positions of the column top locations to both the initial column top locations and to the second column top locations.

12. The system of claim 7, further comprising, determining, by the computing device, a sequence of adjusting the column top locations determined to be adjusted.

13. A non-transitory computer-readable medium comprising instructions, which when executed by a computing device of a system for leveling a foundation, cause the system to perform actions, comprising:

capturing initial column top locations relative to a plane from data communicated by a plurality of sensors;

monitoring positions of the column top locations;

comparing the monitored positions of the column top locations;

detecting, based on the comparison, a settlement of at least one column top location;

analyzing the settlement to determine which of the column top locations to adjust;

determining, for each of the column top locations to adjust, an amount of adjustment to achieve a planar alignment of the column top locations;

causing the at least one actuator to adjust the column top locations determined to achieve the planar alignment of the column top locations; and after achieving the planar alignment of the column top locations, causing the at least one actuator to adjust the column top locations to correct a tilt of the planar alignment.

14. The non-transitory computer-readable medium of claim 13, wherein comparing the monitored positions of the column top locations includes:

comparing the monitored positions of the column top locations to the initial column top locations.

15. The non-transitory computer-readable medium of claim 13, wherein comparing the monitored positions of the column top locations includes:

comparing the monitored position of a first column top location to the monitored positions of the remainder of the column top locations.

16. The non-transitory computer-readable medium of claim 13, the actions further comprising:

communicating an alert to an administrator when the detected settlement exceeds a threshold.

* * * * *